US008926145B2

(12) United States Patent
Lynch et al.

(10) Patent No.: US 8,926,145 B2
(45) Date of Patent: Jan. 6, 2015

(54) LED-BASED LIGHT ENGINE HAVING THERMALLY INSULATED ZONES

(71) Applicant: Permlight Products, Inc., Tustin, CA (US)

(72) Inventors: Fernando Lynch, Orange, CA (US); James Steedly, Huntington Beach, CA (US); Michael Bremser, Tustin, CA (US); Kamran Kohan, Orange, CA (US); Johnny Kean, Tustin, CA (US)

(73) Assignee: Permlight Products, Inc., Tustin, CA (US)

( * ) Notice: Subject to any disclaimer, the term of this patent is extended or adjusted under 35 U.S.C. 154(b) by 0 days.

(21) Appl. No.: 13/776,543

(22) Filed: Feb. 25, 2013

(65) Prior Publication Data

US 2013/0163248 A1 Jun. 27, 2013

Related U.S. Application Data

(63) Continuation of application No. 12/632,759, filed on Dec. 7, 2009, now abandoned.

(60) Provisional application No. 61/171,741, filed on Apr. 22, 2009, provisional application No. 61/154,106, filed on Feb. 20, 2009, provisional application No. 61/152,202, filed on Feb. 12, 2009, provisional application No. 61/120,390, filed on Dec. 5, 2008.

(51) Int. Cl.

| | |
|---|---|
| ***F21V 29/00*** | (2006.01) |
| ***F21S 8/02*** | (2006.01) |
| *F21Y 101/02* | (2006.01) |

(52) U.S. Cl.

CPC ..... *F21S 8/02* (2013.01); *F21V 29/004* (2013.01); *F21Y 2101/02* (2013.01); *F21V 29/2231* (2013.01); *Y10S 362/80* (2013.01)

USPC ..... 362/373; 362/294; 362/249.02; 362/800; 257/99; 257/98

(58) Field of Classification Search

USPC ..... 362/373, 294

See application file for complete search history.

(56) References Cited

U.S. PATENT DOCUMENTS

| | | | |
|---|---|---|---|
| 3,936,686 | A | 2/1976 | Moore |
| 4,591,954 | A | 5/1986 | Kawamura et al. |

(Continued)

FOREIGN PATENT DOCUMENTS

| | | |
|---|---|---|
| DE | 29803105 U1 | 9/1998 |
| EP | 1479286 | 11/2004 |

(Continued)

OTHER PUBLICATIONS

Bergquist Company, Power Systems Design Europe, Thermal Management Made Simple, Dec. 2005.

(Continued)

*Primary Examiner* — Sikha Roy

(74) *Attorney, Agent, or Firm* — Klein, O'Neill & Singh, LLP

(57) ABSTRACT

An LED-based luminaire employs an LED module mounted to a housing. The LED module is advantageously configured to transmit heat generated by the LEDs across and/or through the module and to the housing for dispersal to the environment. LED modules can be configured with conductive or non-conductive cores, and may be configured to evacuate heat from one or both faces of the LED module. Further, multiple heat paths can be defined from components on an LED module to the housing and to the environment.

28 Claims, 25 Drawing Sheets

(56) References Cited

U.S. PATENT DOCUMENTS

| | | | | |
|---|---|---|---|---|
| 4,729,076 | A | 3/1988 | Masami et al. | |
| 5,103,382 | A | 4/1992 | Kondo et al. | |
| 5,107,408 | A | 4/1992 | Vernondier | |
| 5,278,432 | A | 1/1994 | Ignatius et al. | |
| 5,499,170 | A | 3/1996 | Gagne | |
| 5,565,262 | A | 10/1996 | Azzaro et al. | |
| 5,607,227 | A | 3/1997 | Yasumoto et al. | |
| 5,646,826 | A | 7/1997 | Katchmar | |
| 5,660,461 | A | 8/1997 | Ignatius et al. | |
| 5,746,497 | A | 5/1998 | Machida | |
| 5,782,555 | A | 7/1998 | Hochstein | |
| 5,783,909 | A | 7/1998 | Hochstein | |
| 5,785,411 | A | 7/1998 | Komai et al. | |
| 5,785,418 | A | 7/1998 | Hochstein | |
| 5,797,672 | A | 8/1998 | Dobert | |
| 5,857,767 | A | 1/1999 | Hochstein | |
| 6,045,240 | A | 4/2000 | Hochstein | |
| 6,056,420 | A | 5/2000 | Wilson et al. | |
| 6,244,728 | B1 | 6/2001 | Cote et al. | |
| 6,249,267 | B1 | 6/2001 | Ishihara | |
| 6,283,612 | B1 | 9/2001 | Hunter | |
| 6,350,039 | B1 | 2/2002 | Lee | |
| 6,356,448 | B1 | 3/2002 | DiBene, II et al. | |
| 6,367,949 | B1 | 4/2002 | Pederson | |
| 6,371,637 | B1 | 4/2002 | Atchinson et al. | |
| 6,412,971 | B1 | 7/2002 | Wojnarowski et al. | |
| 6,428,189 | B1 | 8/2002 | Hochstein | |
| 6,455,930 | B1 | 9/2002 | Palanisamy et al. | |
| 6,481,874 | B2 | 11/2002 | Petroski | |
| 6,498,355 | B1 | 12/2002 | Harrah et al. | |
| 6,502,968 | B1 | 1/2003 | Simon | |
| 6,509,840 | B2 | 1/2003 | Martineau | |
| 6,517,218 | B2 | 2/2003 | Hochstein | |
| 6,518,502 | B2 | 2/2003 | Hammond et al. | |
| 6,528,954 | B1 | 3/2003 | Lys et al. | |
| 6,536,913 | B1 | 3/2003 | Yajima et al. | |
| 6,578,986 | B2 | 6/2003 | Swaris et al. | |
| 6,582,100 | B1 | 6/2003 | Hochstein et al. | |
| 6,582,103 | B1 | 6/2003 | Popovich et al. | |
| 6,667,623 | B2 | 12/2003 | Bougault et al. | |
| 6,712,486 | B1 | 3/2004 | Popovich et al. | |
| 6,713,862 | B2 | 3/2004 | Palanisamy et al. | |
| 6,720,859 | B2 | 4/2004 | Mazzochette | |
| 6,731,222 | B2 | 5/2004 | Martineau | |
| 6,787,999 | B2 | 9/2004 | Stimac et al. | |
| 6,799,864 | B2 | 10/2004 | Bohler et al. | |
| 6,846,093 | B2 | 1/2005 | Swaris et al. | |
| 6,871,983 | B2 | 3/2005 | Jacob et al. | |
| 6,880,952 | B2 | 4/2005 | Kiraly et al. | |
| 6,917,166 | B2 | 7/2005 | Ito | |
| 6,966,677 | B2 | 11/2005 | Galli | |
| 7,098,483 | B2 | 8/2006 | Mazzochette | |
| 7,102,172 | B2 | 9/2006 | Lynch et al. | |
| 7,108,396 | B2 | 9/2006 | Swaris et al. | |
| 7,114,831 | B2 | 10/2006 | Popovich et al. | |
| 7,165,863 | B1 | 1/2007 | Thomas et al. | |
| 7,176,502 | B2 | 2/2007 | Mazzochette | |
| 7,183,640 | B2 | 2/2007 | Mazzochette et al. | |
| 7,213,940 | B1 | 5/2007 | Van de Ven et al. | |
| 7,252,408 | B2 | 8/2007 | Mazzochette | |
| 7,267,461 | B2 | 9/2007 | Kan et al. | |
| 7,306,353 | B2 | 12/2007 | Popovich | |
| 7,315,049 | B2 | 1/2008 | Raos et al. | |
| 7,329,024 | B2 * | 2/2008 | Lynch et al. | 362/240 |
| 7,387,406 | B2 | 6/2008 | Swaris et al. | |
| D572,385 | S | 7/2008 | Mazzochette | |
| 7,488,097 | B2 | 2/2009 | Reisenauer et al. | |
| 7,497,596 | B2 | 3/2009 | Ge | |
| 7,513,639 | B2 | 4/2009 | Wang | |
| 7,607,802 | B2 | 10/2009 | Kang et al. | |
| 7,614,769 | B2 | 11/2009 | Sell | |
| 7,628,512 | B2 | 12/2009 | Netzel, Sr. et al. | |
| 7,651,245 | B2 | 1/2010 | Thomas et al. | |
| 7,652,303 | B2 | 1/2010 | Galli | |
| 7,654,688 | B2 | 2/2010 | Li et al. | |
| 7,654,703 | B2 | 2/2010 | Kan et al. | |
| 7,676,915 | B2 | 3/2010 | Ter-Hovhannissian | |
| 7,679,096 | B1 | 3/2010 | Ruffin | |
| 7,682,048 | B2 | 3/2010 | Hsu et al. | |
| 7,722,220 | B2 | 5/2010 | Van De Van | |
| 7,815,341 | B2 | 10/2010 | Steedly et al. | |
| 8,079,731 | B2 | 12/2011 | Lynch et al. | |
| 8,154,037 | B2 | 4/2012 | Kadotani et al. | |
| 8,186,850 | B2 | 5/2012 | Popovich et al. | |
| 2003/0072117 | A1 | 4/2003 | Maekawa | |
| 2003/0112627 | A1 | 6/2003 | Deese | |
| 2003/0174517 | A1 | 9/2003 | Kiraly et al. | |
| 2004/0041757 | A1 | 3/2004 | Yang et al. | |
| 2004/0066142 | A1 | 4/2004 | Stimac et al. | |
| 2004/0150954 | A1 | 8/2004 | Belady et al. | |
| 2004/0190305 | A1 | 9/2004 | Arik et al. | |
| 2004/0233671 | A1 | 11/2004 | Staufert | |
| 2005/0128751 | A1 | 6/2005 | Roberge | |
| 2005/0243552 | A1 | 11/2005 | Maxik | |
| 2006/0098440 | A1 | 5/2006 | Allen | |
| 2006/0163957 | A1 | 7/2006 | Johnsen | |
| 2007/0041220 | A1 * | 2/2007 | Lynch | 362/646 |
| 2007/0062032 | A1 | 3/2007 | Ter-Hovhannissian | |
| 2007/0176198 | A1 * | 8/2007 | Lee et al. | 257/99 |
| 2007/0268703 | A1 | 11/2007 | Gasquet et al. | |
| 2007/0285949 | A1 | 12/2007 | Lodhie et al. | |
| 2007/0297177 | A1 * | 12/2007 | Wang et al. | 362/294 |
| 2008/0025028 | A1 | 1/2008 | Gloisten et al. | |
| 2008/0055915 | A1 | 3/2008 | Lynch et al. | |
| 2008/0084701 | A1 | 4/2008 | Van De Ven et al. | |
| 2008/0094857 | A1 * | 4/2008 | Smith et al. | 362/649 |
| 2008/0112168 | A1 | 5/2008 | Pickard et al. | |
| 2008/0144320 | A1 | 6/2008 | Tokunaga | |
| 2008/0165535 | A1 | 7/2008 | Mazzochette | |
| 2008/0175003 | A1 | 7/2008 | Tsou et al. | |
| 2008/0192462 | A1 | 8/2008 | Steedly | |
| 2008/0192463 | A1 | 8/2008 | Fan | |
| 2008/0310162 | A1 | 12/2008 | Thomas et al. | |
| 2009/0027889 | A1 | 1/2009 | Kang et al. | |
| 2009/0034261 | A1 | 2/2009 | Grove | |
| 2009/0046473 | A1 * | 2/2009 | Tsai et al. | 362/373 |
| 2009/0059595 | A1 | 3/2009 | Ge | |
| 2009/0059605 | A1 | 3/2009 | Xu et al. | |
| 2009/0073689 | A1 | 3/2009 | Patrick | |
| 2009/0086488 | A1 | 4/2009 | Lynch et al. | |
| 2009/0129086 | A1 | 5/2009 | Thompson, III | |
| 2009/0129087 | A1 | 5/2009 | Starkey et al. | |
| 2009/0141500 | A1 * | 6/2009 | Peng | 362/294 |
| 2009/0159905 | A1 * | 6/2009 | Chen | 257/88 |
| 2009/0223047 | A1 | 9/2009 | Hochstein | |
| 2009/0284932 | A1 * | 11/2009 | Lin | 361/718 |
| 2009/0290348 | A1 | 11/2009 | Van Laanen et al. | |
| 2009/0296384 | A1 | 12/2009 | Van De Ven et al. | |
| 2010/0026158 | A1 | 2/2010 | Wu | |
| 2010/0060132 | A1 | 3/2010 | Liu et al. | |
| 2010/0164348 | A1 | 7/2010 | Huang et al. | |
| 2010/0181885 | A1 | 7/2010 | Tessnow et al. | |

FOREIGN PATENT DOCUMENTS

| | | |
|---|---|---|
| JP | 9-223820 | 8/1997 |
| JP | 2002-097899 | 4/2002 |
| WO | WO 97/37385 | 10/1997 |
| WO | WO 98/19339 | 5/1998 |
| WO | WO 00/36336 | * 6/2000 |

OTHER PUBLICATIONS

Petroski, James, "Thermal Challenges Facing New Generation LEDs for Lighting Applications," in Solid State Lighting II, Proceedings of SPIE vol. 4776 (2002).

Thermal Management of White LEDs, U.S. Department of Energy, PNNL-SA-51901, Feb. 2007.

* cited by examiner

LED-BASED LIGHT ENGINE HAVING THERMALLY INSULATED ZONES

CROSS-REFERENCE TO RELATED APPLICATIONS

This application is a continuation of U.S. application Ser. No. 12/632,759, filed on Dec. 7, 2009. This application also claims the benefit of U.S. Provisional Application Nos. 61/171,741, filed on Apr. 22, 2009, 61/154,106, filed on Feb. 20, 2009, 61/152,202, filed on Feb. 12, 2009, and 61/120,390, filed on Dec. 5, 2008. The entireties of each of these priority applications are hereby incorporated by reference.

BACKGROUND OF THE INVENTION

1. Field of the Invention

The present invention is in the field of illumination devices and, more specifically, light emitting diode (LED)-based illumination devices.

2. Description of the Related Art

Most lighting applications utilize incandescent or gas-filled bulbs, particularly lighting applications that require more than a low level of illumination. Incandescent bulbs typically do not have long operating lifetimes and thus require frequent replacement. Gas-filled tubes, such as fluorescent or neon tubes, may have longer lifetimes, but operate using dangerously high voltages, are relatively expensive, and include hazardous materials such as mercury. Further, both bulbs and gas-filled tubes consume substantial amounts of power.

In contrast, light emitting diodes (LEDs) are relatively inexpensive, operate at low voltage, and have long operating lifetimes. Additionally, LEDs consume relatively little power, are compact, and do not include toxic substances. These attributes make LEDs particularly desirable and well suited for many applications.

Although it is known that the brightness of the light emitted by an LED can be increased by increasing the electrical current supplied to the LED, increased current also increases the junction temperature of the LED. Excessive heat reduces the efficiency and lifetime of the LED. Advances in LED technology have brought increasingly bright LEDs. However, such increased brightness is accompanied by increased heat-generation.

SUMMARY

Accordingly, there is a need in the art for lighting systems utilizing LEDs and which efficiently evacuate heat away from the LEDs so as to preserve LED lifetime.

In accordance with one embodiment, the present invention provides a light engine comprising, a light emitting diode (LED) module, a first housing, and a second housing. The LED module comprises an electrically nonconductive substrate having a first face and a second face, a first plurality of thermally conductive plates provided on the first face, and a second plurality of thermally conductive plates provided on the second face. Each of the second plurality of plates generally corresponds to a respective one of the first plurality of plates. The LED module further comprises a plurality of thermally conductive vias extending through the substrate. The vias are configured to transfer heat between respective ones of the first plurality of plates and the second plurality of plates. The LED module further comprises a plurality of LEDs arranged in a circuit defined on the first face, where heat generated by the plurality of LEDs is transferred to the first and second plurality of plates. The first housing is formed of a heat-conductive material and has an aperture. The LED module is mounted on the first housing so that the first plurality of plates is disposed adjacent to and thermally connected to the first housing and light from the plurality of LEDs is directed through the aperture. The second housing is formed of a heat-conductive material and connected to the first housing so that the second plurality of plates is adjacent to and thermally connected to the second housing. The LED module is sandwiched between the first and second housings.

In another embodiment, the first and second housings are fastened together such that the LED module sandwiched therebetween is subjected to substantial compression.

In another embodiment, the first and second housings comprise a cavity adapted to accept the LED module therewithin. The cavity has a depth that is less than a thickness of the LED module substrate.

In another embodiment the aperture is formed through a mount wall of the first housing, and the first face generally engages the mount wall so that the LEDs extend past the mount wall and into the cavity. The first face has an inner zone and an outer zone, and the LEDs are disposed in the inner zone, and the outer zone engages the mount wall.

In accordance with another embodiment, the present invention provides a light engine comprising a light emitting diode (LED) module, a first housing, and a second housing. The LED module comprises a generally flat metallic substrate having a first side and a second side, a circuit portion defined on the first side, and a mounting portion formed on the first side. A thin dielectric layer is formed on the circuit portion, a plurality of electrically conductive traces are disposed on the dielectric layer, and a plurality of LEDs are attached to the traces so as to be electrically connected one to another. The mounting portion is characterized by an absence of a dielectric layer. The first housing is formed of a heat-conductive material. The first housing has a mount surface with an aperture formed therethrough, the aperture is sized and configured so that the entire circuit portion fits within the aperture and at least part of the mounting portion of the first side engages the first housing mount surface. The second housing is formed of a heat conductive material and has a mount surface. The first and second housings are connected to one another so that the second housing mount surface engages the second side of the LED module substrate. The LED module is sandwiched between the first and second housings. First and second heat paths are defined, the heat paths extend from the LEDs to an associated circuit trace through the dielectric and to the metallic substrate. The first heat path extends from the metallic substrate through the first face to the first housing and to the environment. The second heat path extends from the metallic substrate through the second face and to the second housing and to the environment.

In another embodiment, the first face mounting portion comprises a substantially bare metal surface, wherein the first housing is metallic, and wherein the first housing mount surface engages the first face mounting portion so as to have metal-to-metal contact between the first face mounting portion and the first housing mount surface.

In another embodiment, the second face comprises a substantially bare metal surface and the second housing is metallic. The second face engages the second housing mount surface so as to have metal-to-metal contact between the second face and the second housing mount surface. The first and second housings may be connected so as to apply compression to the LED module mounted therebetween.

In a further embodiment, the second housing defines a compartment, and further comprising a power conditioner disposed generally within the compartment, the power conditioner conditioning an input power so as to transform the input power to an output power. The power conditioner is spaced from the second housing compartment so as to be thermally insulated from the second housing. The second housing compartment is defined in part by a compartment wall, and comprising a plurality of apertures formed through the compartment wall so as to provide ventilation to the compartment. The apertures may comprise slots.

In accordance with another embodiment, the present invention provides a light engine comprising a light emitting diode (LED) module and a first housing. The LED module comprises a nonconductive substrate having a first side and a second side, the first side having a first region and a second region. The LED module further comprises a plurality of conductive contact pads on the first region, a first plurality of thermally conductive plates on the second region, a plurality of light emitting diodes arranged in a circuit on the second region, a plurality of conductive circuit traces formed on the first side that communicate selectively with the plurality of conductive contact pads and the light emitting diodes, and a plurality of electrical components disposed on the plurality of contact pads. The plurality of electrical components is thermally insulated from the plurality of light emitting diodes such that a substantial portion of the thermal energy generated by the plurality of light emitting diodes is transferred to the first plurality of plates. The first housing is formed of a thermally conductive material and has an aperture. The light emitting diode module is mounted on the first housing so that light from the plurality of light emitting diodes is directed through the aperture. The first plurality of thermally conductive plates of the second region engage the first housing so that heat from the light emitting diodes is directed to the thermally conductive plates and further to the first housing.

In another embodiment, a thermally conductive plate is formed on the second side of the substrate and a conductive via extends through the substrate to thermally connect the second side plate with at least one of the contact pads in the first region.

In another embodiment, the light engine further comprises a second housing formed of a thermally conductive material. The second housing engages the second side plate so that heat from the first region is directed to the second side plate and further to the second housing. The light emitting diode module is sandwiched between the first and second housings. A first heat path is defined from the second region to the first housing, and a second heat path is defined from the first region to the second housing.

In another embodiment, the light engine further comprises a power driver power adapted to receive an input power and output a conditioned power, wherein the power driver is attached to the substrate so as to communicate with at least one of the contact of the first region while being thermally insulated from the second region. The second housing has an aperture formed therethrough. The second housing is attached to the first housing so that the substrate is sandwiched between the first and second housings and the power driver is thermally spaced from each of the first and second housings.

In another embodiment, the light engine further comprises a second plurality of thermally conductive plates formed on the second side of the substrate, each of the second plurality of plates generally corresponding to a respective one of the first plurality of plates. A plurality of thermally conductive vias extends through the substrate. The vias are configured to transfer heat between respective ones of the first plurality of plates and the second plurality of plates. The second plurality of plates is configured such that the first region is substantially thermally insulated from the second region. The second housing engages the second plurality of plates.

Further embodiments can include additional inventive aspects, and apply additional inventive principles that are discussed below in connection with preferred embodiments.

DETAILED DESCRIPTION

The present specification and figures present and discuss embodiments of light emitting diode (LED) modules and LED-based luminaires and LED-based light engines that employ such modules. Structure for the illustrated embodiments is discussed herein, as are methods for making such embodiments in accordance with the structure. It is to be understood that the specific embodiments disclosed herein are presented as examples, and the technology and principles described herein can be applied to other configurations and technologies that involve a circuit board with componentry mounted thereon.

Figure 1:
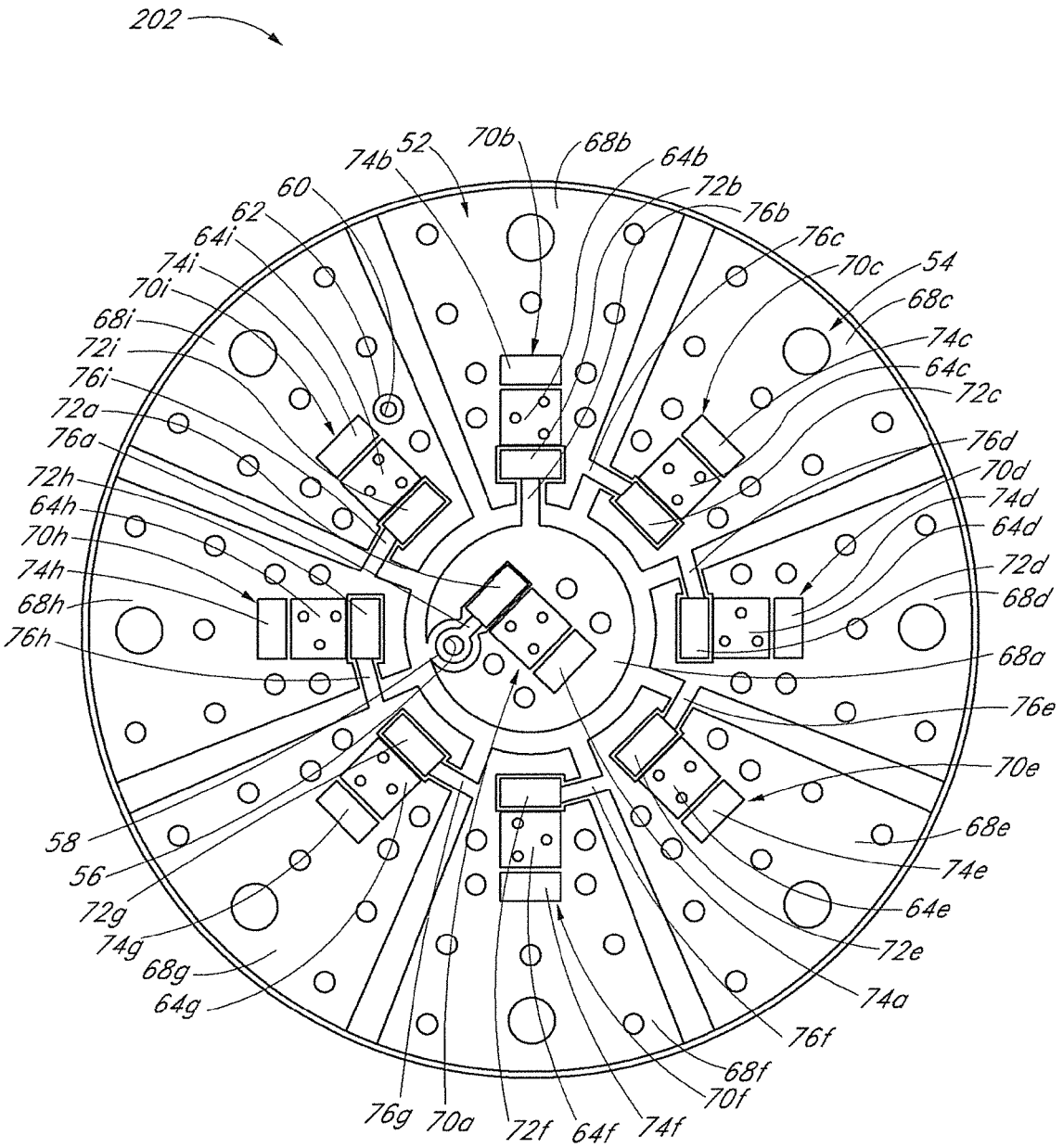
FIG. 1 shows an embodiment of an LED module in accordance with one embodiment.
Figure 2:
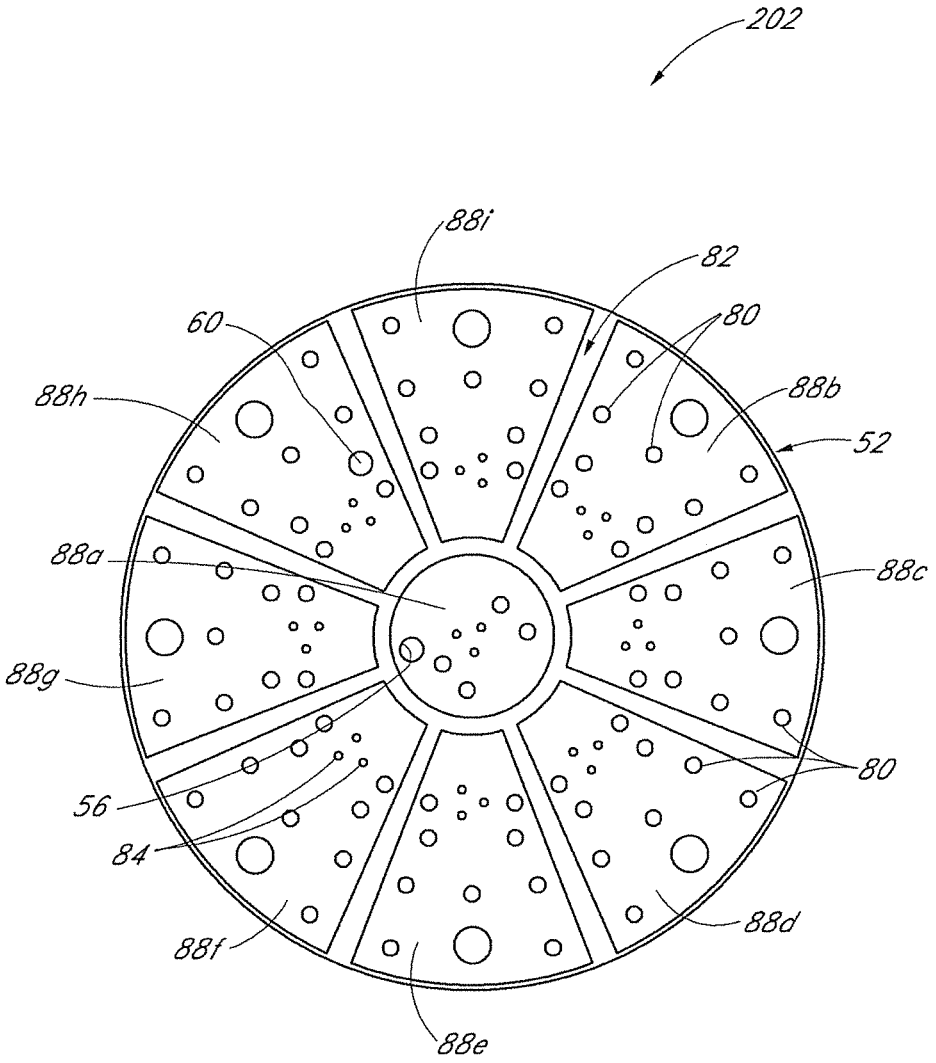
FIG. 2 is a back-side view of the embodiment of FIG. 1.

FIGS. 1 and 2 illustrate one embodiment of a light emitting diode (LED) lighting module, which is adapted to provide light for an LED-based luminaire. The LED module 202 comprises a printed circuit board 52 upon which LEDs and associated power delivery circuitry is mounted. FIG. 1 shows a first, or front, face 54 of the circuit board 52 and FIG. 2 shows a second, or back, face 842 of the printed circuit board for use in such an LED module 202.

Preferably, the circuit board comprises a body, or core, formed of a dielectric material, such as conventional FR4 material. Such material is not electrically conductive; thus electrical circuit traces, contact pads and the like can be placed on the circuit board body and be electrically insulated relative to one another. In the illustrated embodiment, the material from which the circuit board body 52 is FR4, which is not particularly heat conductive. More specifically, FR4 material has low heat conductance properties. Other embodiments may employ other materials for the core.

With reference to FIG. 1, the front face 54 of the circuit board body 52 has areas of conductive material disposed thereon. More particularly, electrical leads 76, contact pads 64, 72, 74 and plates 68 are disposed on the front face. The electrical leads 76, contact pads 64 and plates 68 preferably are formed of a thin layer of conductive material such as copper or another metal that has been etched, printed or otherwise provided on the dielectric circuit board body 52. In some embodiments, the leads, pads, and plates are mostly covered with a masking material in order to protect the circuit board.

The illustrated plates 68 are electrically conductive and are preferably large and flat. As such, the plates 68 spread heat generated by components mounted thereon over a large area. Heat generated by the components is drawn out of the components and spread across the corresponding plate. The plates are not limited to any particular shape or size, but preferably, the plates are sized to make the most effective use of the circuit board.

The contact pads 64, 72, 74 or solder pads, are configured to enable and support the mounting of certain electrical components on the circuit board 52 in a conventional manner in which connectors of the components are soldered to the contact pads 64, 72, 74. The electrical leads 76, or circuit leads, are electrically conductive portions that communicate electric current to contact pads 72. The contact pads 64, 72, 74 and electrical leads 76 are generally contiguous with one of the corresponding plates.

With continued reference to FIG. 1, a first or center plate 68*a* is disposed generally centrally in the circuit board 52. A first power aperture 56 is formed through the circuit board 52 and the first plate 68*a* and is generally encircled by a power contact pad 58, which electrically communicates with a first lead 76*a*. The first power contact pad 58 and first lead 76*a* are electrically spaced from the first front plate 68*a*. A first LED mount 70*a* comprises a first connector pad 72*a* defined on the first lead 76*a*, a second connector pad 74*a* defined on the first front plate 68*a*, and a slug pad 64*a* disposed on the first front plate 68*a*.

A second lead 76*b* extends from the first front plate 68*a* into, but not electrically communicating with, a second front plate 68*b*. A second LED mount 70*b* comprises a first connector pad 72*b* disposed on the second lead 76*b* so as to be adjacent a slug pad 64*b* and second connector pad 74*b* disposed on the second plate 68*b*.

As shown in FIG. 1, preferably a repeating pattern is established. More particularly, a third lead 76*c* extends from the second plate 68*b* and into but not electrically communicating with an adjacent third plate 68*c*. A third LED mount 70*c* comprises a first connector pad 72*c* disposed on the third lead 76*c* so as to be adjacent a second connector pad 74*c* and slug pad 64*c* disposed on the third plate 68*c*. Similarly, a fourth lead 76*d* extends from the third plate 18*c* and into but electrically spaced from an adjacent fourth plate 68*d*. The fourth LED mount 70*d* comprises a first connector pad 72*d* disposed on the fourth lead 76*d* so as to be adjacent a second connector pad 74*d* and slug pad 64*d* disposed on the fourth plate 68*d*. A similar pattern persists through a fifth lead 76*e*, fifth plate 68*e*, fifth mount 70*e*, sixth lead 76*f*, sixth plate 68*f*, sixth mount 70*f*, seventh lead 76*g*, seventh plate 68*g*, seventh mount 70*g*, eighth lead 76*h*, eighth plate 68*h*, eighth mount 70*h*, ninth lead 76*i*, ninth plate 68*i*, and ninth mount 70*i*.

In the illustrated embodiment the pads are portions or zones of associated leads and plates that are configured to accept attachment of components. More specifically, the pads are coated with a solder layer to facilitate such attachment, while the remainder of the leads and plates is covered with a protective mask layer.

The illustrated ninth plate 68*i* has a power return aperture 60 formed therethrough, which aperture 60 extends through the circuit board 52. A power return contact pad 62 is disposed about the power return aperture 60. The return power contact pad 62 communicates with and is part of the ninth plate 68*i*, and is also adapted to support wires of a power wire to be soldered onto the return power contact pad 62.

The illustrated embodiment provides a circuit architecture in which the first through ninth LED mounts 70*a-i* are arranged electrically in series.

With continued reference to FIGS. 1 and 2, in the illustrated embodiment, the circuit board 52 also has first through ninth plates 88*a-i* formed on the back face 82 of the circuit board 52. The first through ninth back plates 88*a-i* generally correspond in size and position to the respective first through ninth front plates 68*a-i*. Several vias 80 extend through the circuit board body 52 to connect respective front 18 and back plates 48. Each via 80 preferably comprises a heat pipe configured to communicate heat between the front and back plates 68, 88. In some embodiments, each conductive via comprises a hole formed through the circuit board body, which hole is lined or filled with a conductive material such as copper or another metal. An arrangement as discussed above provides advantageous heat management properties. Specifically, the vias communicate heat between the front and back plates, and thus the effective heat bearing surface area of each front plate is dramatically increased, effectively doubled in this embodiment. As such, when heat is generated by an LED, the heat is drawn out of the LED package and spread into the front and back plates, from which it is disbursed to the environment and/or an adjacent heat sink. Notably, multiple smaller-sized vias 84 are placed to correspond to each slug pad 64. Placing smaller vias 84 better utilizes the area and enables the placement of more vias in particularly heat-sensitive areas.

Figure 3:
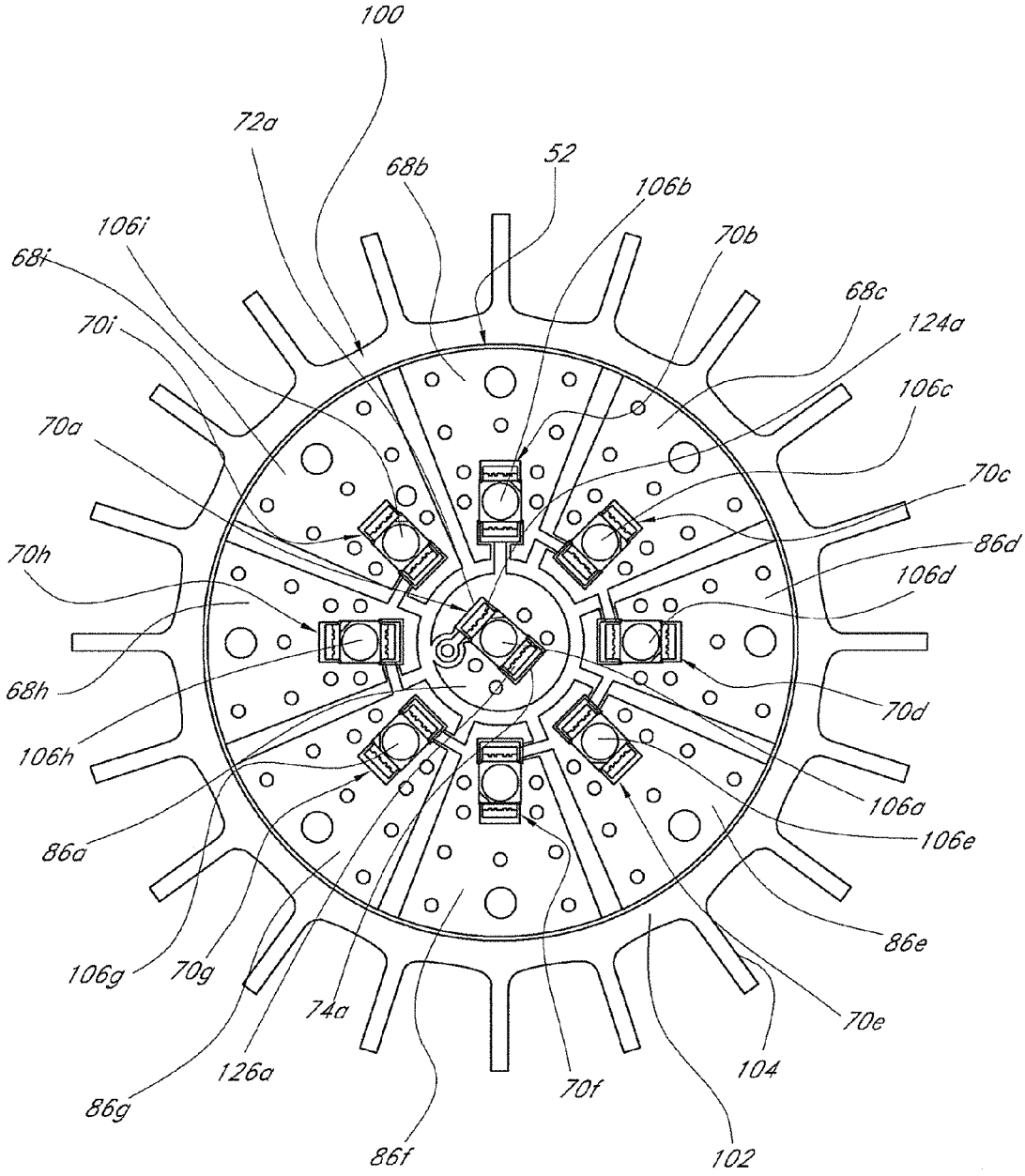
FIG. 3 shows the embodiment of FIG. 1 mounted on a housing and having LEDs disposed thereon.

FIG. 3 illustrates an embodiment of an LED lighting module 100 using the circuit board 52 illustrated in FIGS. 1 and 2, in which first through ninth LED packages 106*a-i* have been mounted on the first through ninth LED mounts 70*a-i*, respectively. In addition, the back face 82 of the circuit board 52 has been mounted on a housing 102 fabricated from a thermally conductive material.

Figure 4:
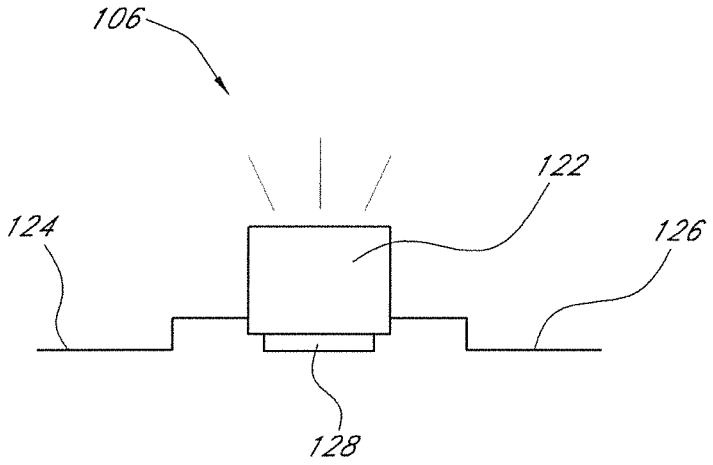
FIG. 4 is a schematic view of an embodiment of an LED.

FIG. 4 illustrates an example of a typical LED package 106 having a first connector 124, a body 122, and a second connector 126. When electrical current is input through the first connector 124, it flows into the body 122, which houses a die. Electric current then flows out of the package through the second connector 126. The die lights as electric current passes through it. During operation of the LED package 106, significant heat is generated by the lit die. As discussed above, LEDs function best when a junction temperature of the die is kept below a threshold value. In the illustrated embodiment, a conductive metal slug 128 is provided immediately below the die so that heat generated by the die is communicated to the slug 128.

With continued reference to FIGS. 1 and 3, when properly soldered or otherwise attached into place, the first connector 124*a* of a first LED package 106*a* connects to the first connector pad 72*a* on the first lead 76*a*, the second connector 126*a* of the first LED package 106*a* connects to the second connector pad 74*a* on the first front plate 68*a*, and the slug 128*a* of the LED package 106*a* engages the slug pad 64*a* of the first front plate 68*a*. As such, electric current is provided from the first connector 124*a* through the body 122*a* and out of the second connector 126*a*, but heat from the slug 128*a* is communicated into the slug pad 64*a* and further to the first plate 68*a*. Some, though comparatively little, heat is also communicated through the first and second connectors 124*a*, 126*a* into associated first and second connector pads and further to the associated lead and/or plate.

In operation, each of the first through ninth LEDs 106*a-i* produces significant heat. Such heat is communicated to a larger surface area by transferring the heat to the associated front 68 and back plates 88 through both the smaller 84 and larger vias 80. The heat can then be evacuated from the plates 68, 88 to the housing 102 and the ambient environment. Thus, heat generated by each LED 106 is drawn away from the LED 106 and into the environment. In order to avoid potential damage to the die, heat is preferably transferred from the LED 106 at a rate that maintains the junction temperature of the die below a threshold value.

In the embodiment illustrated in FIG. 3 the back face 82 of the circuit board 52 is attached to the housing 102. The housing 102 is preferably constructed from a material having high heat conductance properties, such as aluminum. The back face 82 of the circuit body 52 may be attached to the housing 102 by a VHB tape or other medium that electrically insulates the back plates 88 from the housing 102 but facilitates heat transfer from the back plates 88 through the medium and into the housing 102. In the illustrated embodiment, the housing has a plurality of fins 104 to help dissipate heat to the environment.

Thus, in the embodiment illustrated in FIG. 3, heat generated by LEDs 106 is spread across the front plates 68 and the back plates 88, and heat from the back plates 88 is communicated to the housing 102 and disbursed to the environment. This advantageous heat transfer structure helps prevent the die portion of the LED package from getting excessively hot, which heat could potentially damage the die. Notably, in some embodiments, a housing portion is also attached to the front portion of the circuit board body. As such, heat is evacuated to a back housing through the back plates and simultaneously to a front housing through the front plates.

The LED module discussed above employs a particular structure in which nine LEDs are connected in electrical series. It is to be understood that other embodiments may employ principles as discussed above on configurations having more or fewer plates, leads and LEDs employing different mounting configurations and circuit architecture, such as electrically parallel configurations.

Figure 5B:
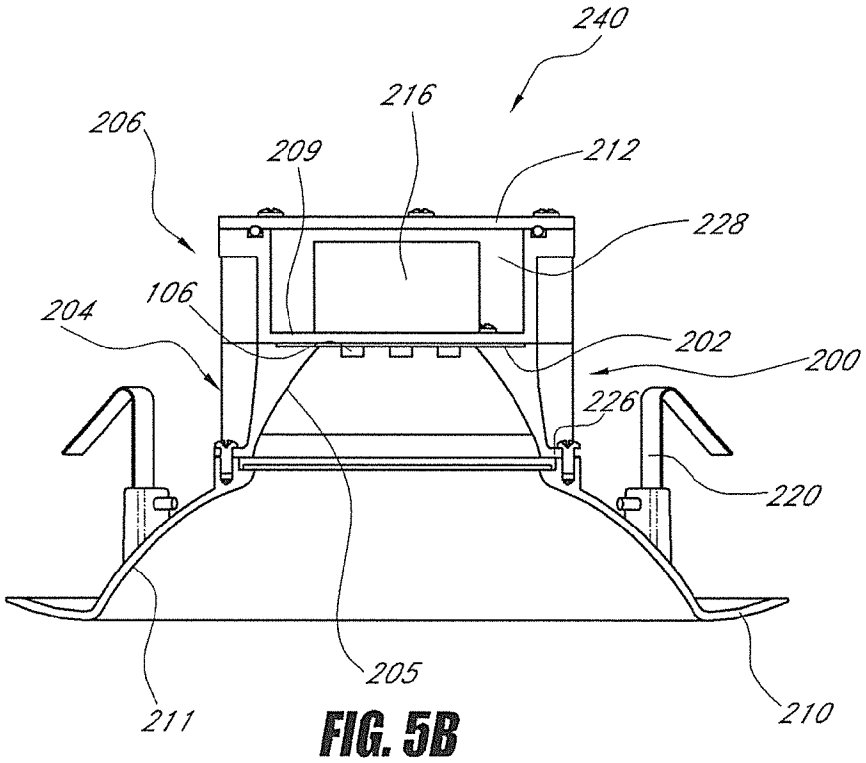
FIG. 5B is cross-sectional view of the luminaire of FIG. 5A taken along line 5B-5B.
Figure 5A:
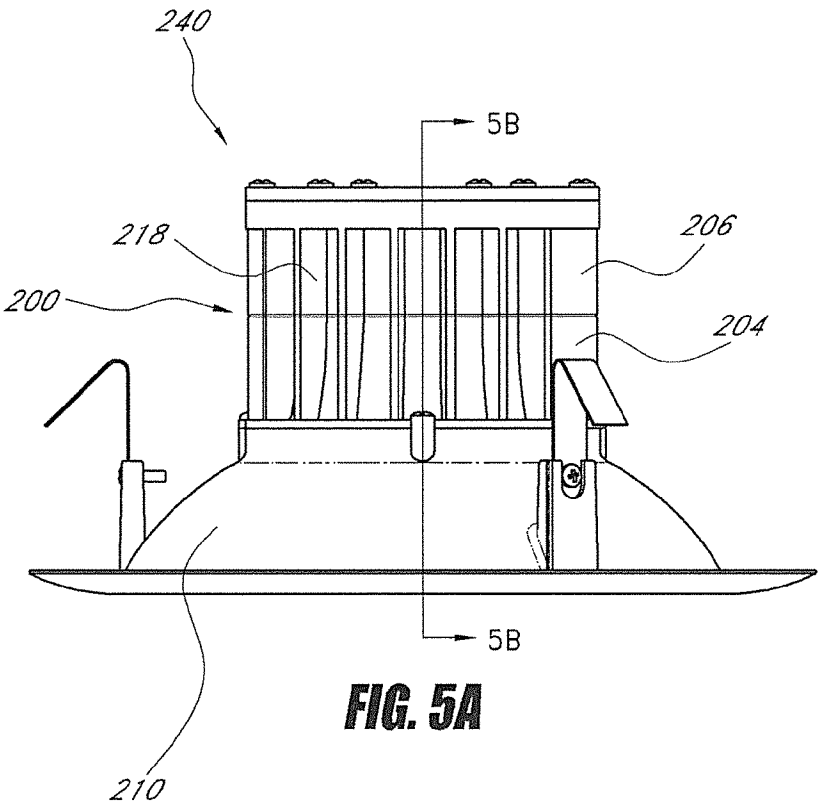
FIG. 5A is a side view of a an LED-based luminaire in accordance with one embodiment.
Figure 6:
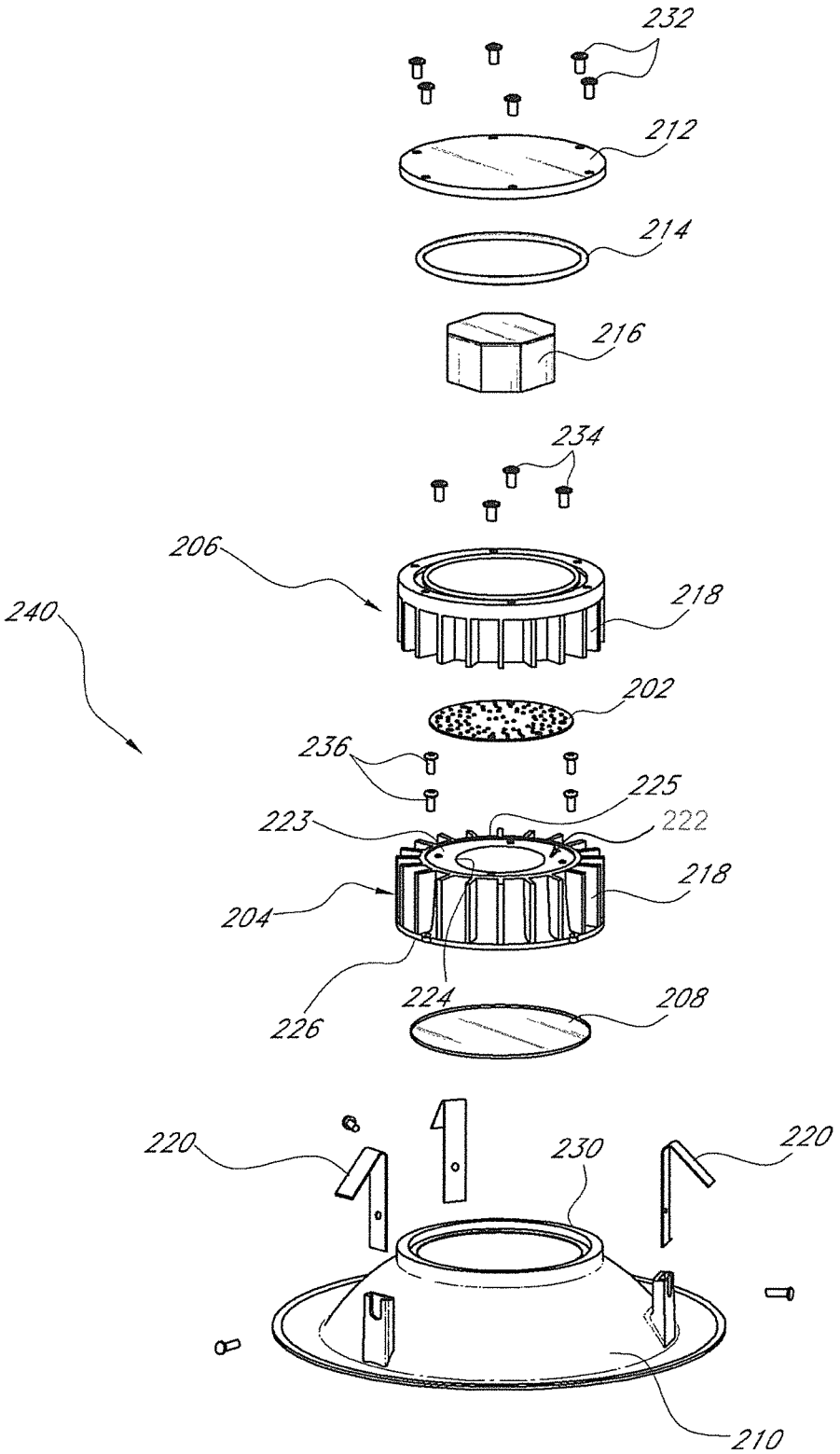
FIG. 6 is an exploded view of the embodiment of FIG. 5A.

With reference next to FIGS. 5 and 6, an embodiment of a luminaire 240 employing an LED-based light engine 200 is shown. The light engine 200 employs an LED-based lighting module and has advantageous heat-transfer properties. The resulting luminaire can be easily customized to a desired look without requiring modification of the light engine. In one embodiment, the light engine employs the LED module 202 as described above.

The illustrated luminaire 240 comprises the light engine 200 and an attached trim portion 210, and is configured to be used as a ceiling-mounted down-light. The trim 210 in this embodiment is generally bowl-shaped, so as to help direct light in a generally downward direction, and includes mount members 220 to help mount the luminaire 240 in place. The trim 210 is connected to the light engine 200 at a flange 230.

The light engine 200 comprises a first housing 204 and a second housing 206. Preferably both the first and second housings 204, 206 are formed of a heat-conductive material such as aluminum. As such, both housings can function as heat sinks. Although both illustrated housings comprise fins 218 to help transfer heat to the environment, it is to be understood that other structures that facilitate heat transfer may be employed.

The first housing 204 comprises a flange 226 adapted to complement and engage the trim flange 230. In some embodiments a lens 208 is arranged between the first housing 204 and the attached trim 210. Preferably the first housing 204 comprises a bowl portion 205, which generally aligns with a bowl portion 211 of the trim 210. A cavity 222 is formed in the back side of the illustrated first housing 204. The cavity 222 is defined by a cavity surface 223 and a surrounding circumferential cavity wall 225. The cavity wall 225 preferably is sized to accommodate at least a portion of the thickness of the LED module 202. Preferably the cavity wall 225 has a longitudinal length that is less than a thickness of the LED module circuit board 52. An aperture 224 is formed through the first housing 204, and allows light from the LEDs on the LED module 202 to be directed into the bowl portion 205 of the first housing 204 and out of the light engine 200. In the illustrated embodiment, the LED packages 106 extend through the aperture 224 beyond the cavity surface 223. In a preferred embodiment, bolts 236 extend through the first housing flange 226 to engage the trim 210 and secure it in place against the first housing flange 226.

With continued reference to FIGS. 5 and 6, the second housing 206 fits generally behind the first housing 204, and preferably is aligned therewith. Preferably the LED module 202 is sandwiched between the first and second housings 204, 206. In the illustrated embodiment bolts 234 extend through the front wall 209 of the second housing 206, through the LED module 202, and engage the first housing 204 so as to hold the first 204 and second housings 206 together with the LED module 202 sandwiched therebetween. Preferably substantial compression is exerted on the LED module 202, so that the copper contacts fit tightly against housing surfaces, thus providing more efficient and effective heat transfer junction between the module and the housings. Applicants have also noted that such pressure can make the vias operate more efficiently to transfer heat between the faces of the LED module.

A compartment 228 is formed in the second housing 206, and, preferably, a power conditioner 216 is disposed in the compartment 228. The power conditioner 216 conditions power into a form palatable for LEDs. For example, in one embodiment the power conditioner 216 receives 120 VAC wall power and converts it into a DC current of 9V, 10V, 12V or the like, as necessary for the LEDs on the LED module. The power conditioner can also be configured to perform other functions with regard to power delivery, such as varying current or voltage to affect LED brightness. Preferably wires from the power conditioner extend through apertures in the front wall 209 of the second housing 206 and further through apertures in the LED module 202 to connect to contact pads on the LED module 202 so as to supply power to the circuit defined on the module.

A plate 212 preferably encloses the compartment 228 of the second housing 206. Preferably an o-ring 214 is provided about the circumference of the compartment opening so that the compartment 228 is substantially sealed from the environment when the plate 212 is secured to the second housing 206 using bolts 232 or a similar fastener. Preferably a water-tight pathway is provided for outside power to be supplied to the power conditioner 216 in the compartment 228.

In assembly, preferably a tape such as a VHB tape is applied to the second side of the LED module 202, and the module 202 is adhered to the front wall 209 of the second housing 206. This ensures maintenance of a desired alignment of the LED module 202 to facilitate assembly, and also provides an electrically insulative layer preventing a short between contacts on the module 202 in embodiments where the second housing 206 is formed from metal. In some embodiments a thin dielectric gasket or tape is disposed between the cavity wall first housing and the front side of the LED module, also to electrically isolate the module contacts from the first housing. Preferably the dielectric is chosen to have low resistance to heat flowing therethrough so as to facilitate a heat pathway from the front plates to the first housing.

During manufacture of a circuit board, the copper surfaces of the leads, plates, and the like typically is "tinned," which involves depositing a thin layer of solder on top of the copper. This thin layer of solder covers the copper layer, and prevents formation of an oxide on the copper layer, which oxide forms naturally upon exposure of the copper to the environment.

In one embodiment, when "tinning" a two-sided PCB, such as the circuit board of the LED module described above, both the first and second sides are "tinned," even though the circuit components are mounted only on the first side. Thus, a thin layer of solder is applied to the copper layers on both the first and second sides. In some embodiments, a masking layer is applied on top of or instead of one or more of the tinning layers. The masking layer preferably serves a purpose of protecting the circuit board and giving it a finished look.

Figure 7:
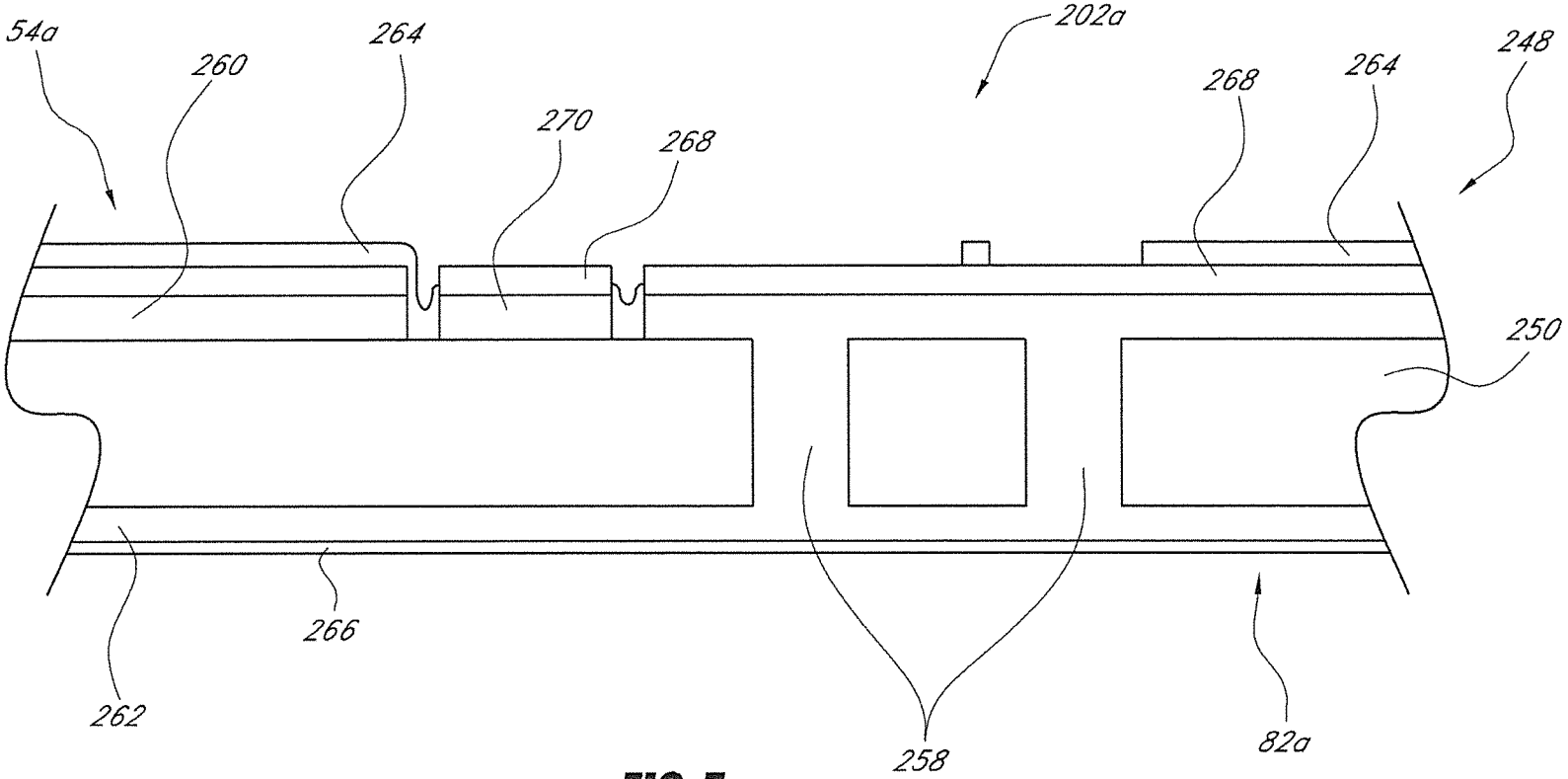
FIG. 7 is a cross-sectional view of an embodiment of an LED module, shown as a section of a circuit board having similarities to the circuit board of FIG. 1 taken at and adjacent solder pads.

Another embodiment is depicted in FIG. 7, which is a sectional view of a circuit board 202*a* having structure similar to that of FIG. 1, taken at and adjacent contact pads and through vias 258. During manufacture of the illustrated two-sided PCB 202*a* only the copper layer of the first side 54*a* is tinned. The copper layer on the second side 82*a* is thus purposefully allowed to form the oxide layer 266 that naturally forms upon exposing the copper to the environment. Thus, as shown, the circuit board 248 comprises a non-conductive body 250, such as FR4, having a front plate 260 and a back plate 262. Conductive vias 258 extend through the body portion 250 to connect the front and back plates 260, 262 so that heat flows freely therebetween. A tinning layer 268, comprising a thin layer of solder, is deposited on the front plate 260 and a lead 270, and a masking material 264 preferably is disposed over the entire front side of the circuit board 202*a* except for first 254, second 256, and slug solder pads 252 defined on the front plate 260 and lead 270.

The back face of the circuit board 250 has copper back plates 262, and a thin layer of naturally-occurring oxide layer 266 is allowed to form on the back plates 262. In another embodiment, a mask layer may be disposed over the oxide layer 266.

The oxide that is allowed to form on the second side is difficult to remove, and would remain in place even if there were subsequent soldering. Solder does not stick particularly well to the oxide; thus, later-soldered-on components would not stick particularly well. On the other hand, the oxide layer does not form on the solder pads on the tinned first side. Thus, when electrical components are soldered into place on the solder pads, the solder process works well and the newly applied solder and components stick together very well, enabling a secure soldered connection of the electrical component to the associated solder pad on the circuit board.

Preferably, as discussed above, electrical components are soldered only onto the first side, and the second side of the circuit board is mounted flush with a heat sink or other high-heat-transfer material so that heat from the electrical components is directed from the first side of the PCB through the vias to the second side and then to the heat sink.

By purposefully not "tinning" the copper plates on its second side, the illustrated circuit board avoids the deposition of a layer of solder, which is not a good heat conductor. The naturally-occurring oxide layer is extremely thin, and thus heat transfer from the non-tinned second-side copper plates to the environment encounters significantly less resistance than if the second-side copper plates were tinned. As such, tinning only the first, component bearing side of the PCB improves the heat transfer properties of the module.

In still another embodiment, only a portion of the copper traces, even on a component-mounting side of a PCB, are tinned. For example, the solder layer for tinning is only applied to solder pads and the rest of the plates and traces are allowed to grow the oxide.

Figure 8:
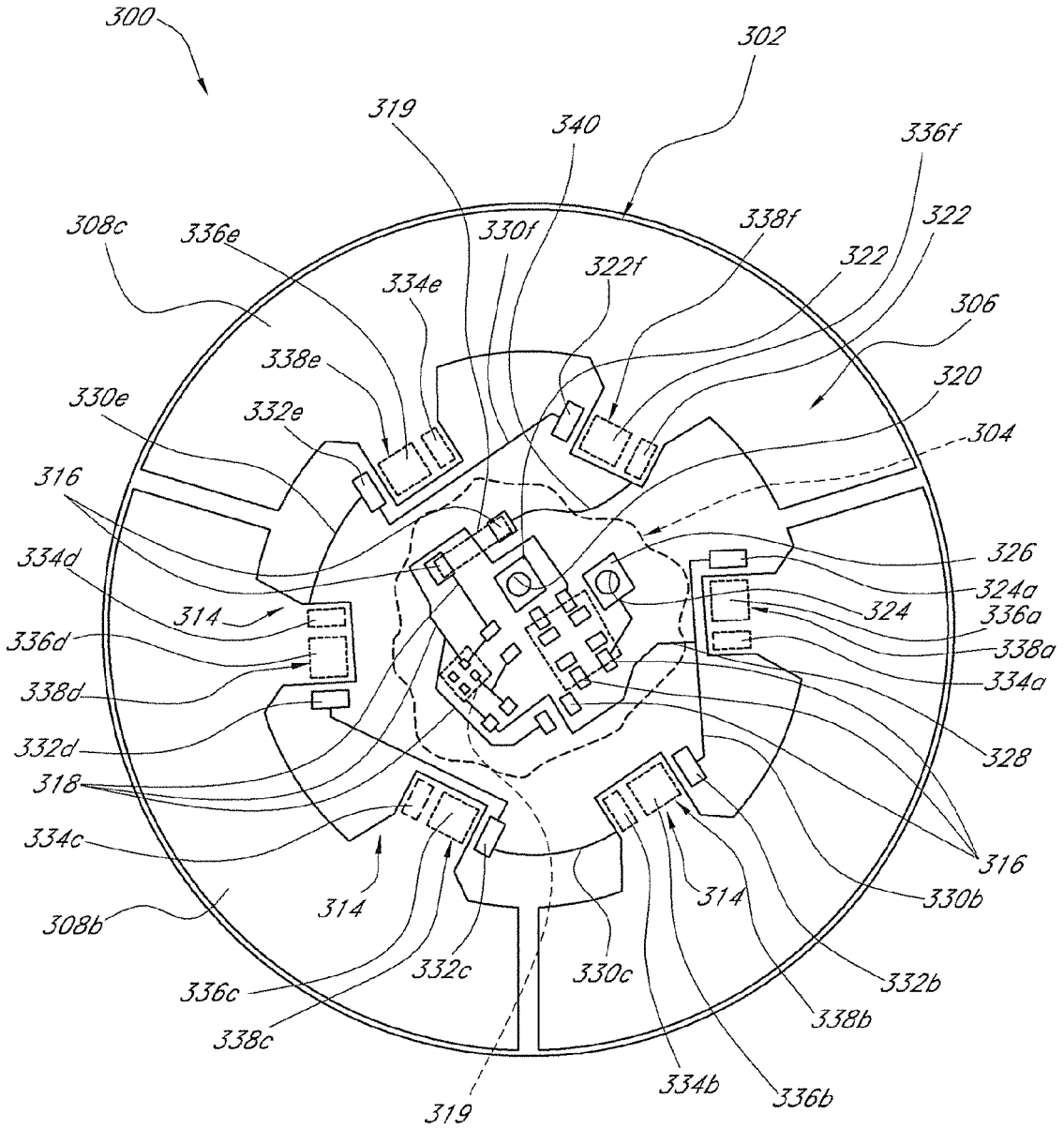
FIG. 8 shows another embodiment of an LED module.

With reference next to FIG. 8, another embodiment of an LED lighting module is illustrated. This embodiment is also configured to be used in certain embodiments of LED-based luminaires and LED-based light engines. In some embodiments, heat transfer pathways are established to draw heat generated by heat-generating components of the module away from other module components that could be damaged by such heat.

Figure 9:
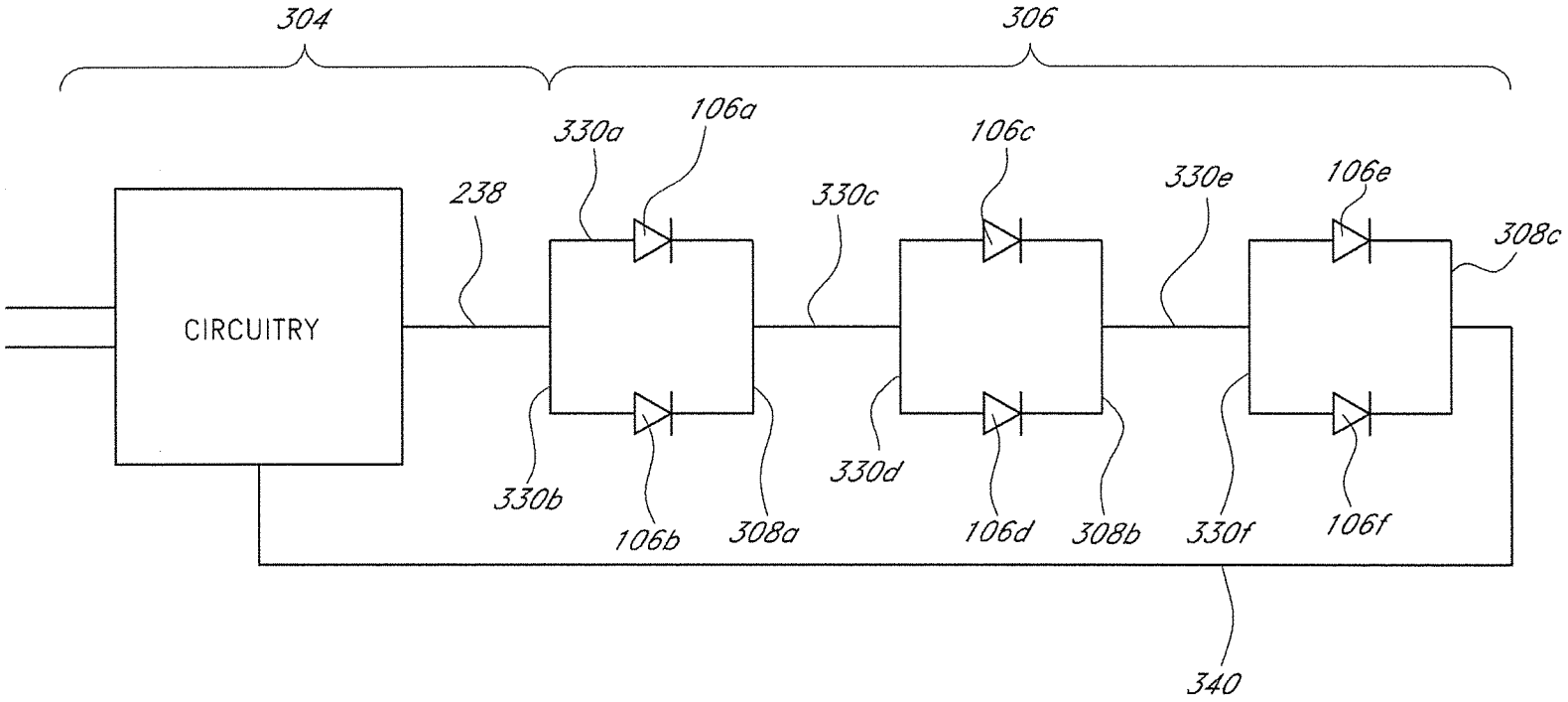
FIG. 9 is a schematic representation of an electrical circuit of an LED module as in FIG. 8.

The embodiment depicted in FIGS. 8 and 9 comprises an LED lighting module 300 that is adapted to provide light for an LED-based luminaire. The LED module 300 comprises a printed circuit board 302 upon which LEDs and associated power delivery and control circuitry is placed. Preferably, the circuit board 302 comprises a body formed of a dielectric material, such as conventional FR4 material. Such material is not electrically conductive, thus electrical circuit traces, contact pads and the like can be placed directly on the circuit board body and be electrically insulated relative to one another. In a preferred embodiment, the material from which the circuit board body 302 is made has low heat conductance properties, and can be considered heat insulative.

The illustrated circuit board body has a first, or front, side and a second, or back, side. Preferably the first side has areas of conductive material disposed thereon. More particularly, a plurality of conductive circuit traces 318, 328, 330, 340 are formed on the first side, and communicate selectively with several conductive contact pads 316, 332, 334 and plates 308, also formed on the first side. The contact pads 316, 332, 334, or solder pads, are configured to enable and support mounting of certain electrical componentry on the circuit board in a conventional manner in which connectors of the componentry are soldered to the contact pads. The circuit traces, pads and plates 308 preferably are formed of a layer of an electrically conductive material such as copper or other metals that have been etched, printed, or otherwise provided on the front side of the dielectric circuit board body.

The illustrated circuit board 302 is generally circular and has a circumferential outer portion 306, or second portion, and an inner portion 304, or first portion, surrounded by the outer portion 306. In the inner portion 304, first and second apertures 320, 324 are formed through the body 300 to provide an access for first and second power wires. A conductive power supply contact pad 322, 326 is provided at and around each power aperture 320, 324 so that a respective power wire extending through the aperture can be soldered or otherwise connected to the circuit board. As shown, the inner portion 304 of the circuit board 302 comprises several thin circuit traces 318 configured to communicate electrical power from the power-supply contact pads 322, 326 to several component contact pads 316, which provide solder pads for selected electrical components 319 such as, for example, controllers, integrated circuits, jumpers, power conditioners, dimmers, or the like. The circuit traces 318 effectively communicate electrical energy. However, due to their thin and narrow construction, they do not communicate much heat very effectively. A masking material may be provided over the traces 318, and a solder mask may be provided on the solder pads 316.

Continuing with reference to FIG. 8, the outer portion 306 comprises first, second and third relatively large plates 308*a-c* disposed about the circumference of the circuit board 302. Each plate 308 preferably comprises a relatively large deposit of conductive material. It is to be understood that any material having high heat conductivity properties can be used for the plate. In the illustrated embodiment, the plates 308 are made of the same copper layer as the rest of the circuit traces and pads, and are etched or otherwise deposited at the same time as the rest of the circuitry.

Each of the plates 308 includes first and second inwardly-extending portions 314. An LED package mounting pad arrangement (LED mount) 338 is provided on and adjacent each inwardly-extending portion. Each LED mount 338 comprises a first LED connector pad 332 adjacent the associated inwardly-extending portion but not electrically connected thereto, a second connector pad 334 defined on the inwardly-extending portion, and a slug pad 336 also defined on the inwardly-extending portion.

Continuing with reference to FIGS. 8 and 9, and also FIG. 4, and preferably consistent with embodiments discussed above, when properly installed, for each LED mount the first connector 124 of an associated LED package 106 connects to the first connector pad 332 of the circuit board body 302, the second connector 126 of the associated LED package 106 connects to the second connector pad 334 of the circuit board body 302, and the slug 128 of the associated LED package 106 engages the slug pad 336 of the circuit board body 302. As such, electric current is provided from the first connector 124 through the body 122 and out the second connector 126, and heat from the slug 128 is communicated into the slug pad 336 and further to the corresponding plate 308.

First and second LED mounts 338*a*, 338*b* are associated with the first plate 308*a*. As discussed above, circuitry disposed in the inner portion 304 of the circuit board is directed to conditioning the power for delivery to LEDs 106. A power supply trace 328 extends from the circuitry in the inner portion 304 and is split into first and second power traces 330*a*, 330*b*, which each lead to a respective first connecting pad 332*a*, 332*b* of each of the first and second LED mounts 338*a*, 338*b*.

With particular reference to FIG. 9, a schematic representation of the circuit 350 of FIG. 8 is provided. As shown, the power trace extends from the control circuitry in the inner portion 304 to LEDs in the outer portion 306. More specifically, since the second connector pads 334*a*, 334*b* of the first and second LED mounts 338*a*, 338*b* both communicate with the first plate 308*a*, first and second LEDs 106*a*, 106*b* which are mounted on the first and second LED mounts 338*a*, 338*b*, respectively, are disposed in electrical parallel relative to one another.

Continuing with reference to FIGS. 8 and 9, a third power trace 330*c* extends from the inwardly-extending portion of the first plate 308*a* to a first connector pad 332*c* of the third LED mount 338*c*. Also, a fourth power trace 330*d* extends from the first connector pad 332*c* of the third LED mount 338*c* to the first connector pad 332*d* of the fourth LED mount 338*d*. As with the first and second LED mounts 338*a*, 338*b*, the second connector pads 334*c, d* of both the third and fourth LED mounts 338*c*, 338*d* are part of the second plate 308*b*. As such, when third and fourth LEDs 106*c*, 106*d* are connected to the third and fourth LED mounts 338*c*, 338*d*, respectively, they are electrically parallel relative to one another as shown in FIG. 9. However, as also illustrated in FIG. 9, the parallel third and fourth LEDs are electrically in series relative to the first and second LEDs.

Fifth and sixth LED mounts 338*e*, 338*f* are disposed at and adjacent a third mount plate 308*c*. A fifth power trace 330*e* extends from the second mount plate 308*b* to a first connector pad 332*e* of the fifth LED mount 338*e*, and a sixth power trace 330*f* extends from the first connector pad 332*e* of the fifth LED mount 338*e* to the first connector pad 332*f* of the sixth LED mount 338*f*. The second connector pads 334*e*, 334*f* of the fifth and sixth LED mounts 338*e*, 338*f* are contiguous with the third plate 308*c* as shown in FIG. 8. As such, fifth and sixth LEDs 106*e*, 106*f* are attached to the fifth and sixth LED mounts 338*e*, 338*f*, respectively, will be electrically in parallel with one another, but electrically in series with the parallel third and fourth LEDs 106*c*, 106*d*.

A return power trace 340 extends from the second pad 334*f* of the sixth LED mount 338*f*, which is electrically contiguous with the third plate 308*c*, back to the circuitry in the inner portion 304 of the circuit board. In summary, in the illustrated embodiment, electric power is provided to the inner portion, which includes circuitry and componentry to condition, dim or otherwise treat such electric power. The treated power is then communicated to the outer portion, in which LEDs convert the power into light and heat.

As discussed above, the body of the circuit board preferably is made of a non-heat-conductive material. Further, in the illustrated embodiment there is no conductive layer on the opposite or back face of the circuit board. Thus, heat that is created by each LED 106*a-f* is communicated through the corresponding slug to one of the first, second, and third plates 308*a-c* that are disposed in the outer portion 306 of the front face of the circuit board 302. Due to their relatively-large size, the plates are amenable to accepting such heat, and heat flows readily into the plates. A relatively small portion of heat from the LED die is communicated to the first and second connectors 124, 126 of the LED package 106. The heat that goes to the second connector 126 of the LED package 106 is also communicated to the associated plate 308. However, the first connector 124 is attached to a very narrow circuit trace 318. Although this circuit trace 318 will conduct some heat, its narrow construction and relatively-long length severely limits the amount of heat that it can conduct. The same is true for the power delivery trace 328 and the power return trace 340.

Due to this construction, substantially all of the heat generated by the LEDs is communicated to the relatively-large plates, which function as heat sinks. At the very least, each plate functions as a heat spreader to distribute the heat across a relatively large surface area for more efficient dispersion to the environment or an appropriate mount portion.

As just discussed, the power supply trace 328 and power return trace 340 preferably are sufficiently long and thin that they do not communicate a substantial amount of heat from the LEDs to the circuitry and componentry in the inner portion 304. Also, as discussed above, the componentry in the inner portion 304 of the circuit board 302 is mounted on a heat insulating material. Thus, the inner portion 304 is, in effect, a heat insulated zone, while the outer portion 306 is a heat management zone in which heat is generated and managed. In fact, since the heat from the LEDs is disposed on inwardly-extending portions 314 of each respective plate, and heat flows from LEDs to the respective inwardly-extending portions and then out to the rest of the plate, a heat pathway is defined from the LEDs outwardly toward the outer circumference of the circuit board and away from the inner portion 304, or insulated zone. As such, the componentry in the inner or insulated zone 304 is insulated from the heat generated by the LEDs.

Figure 10B:
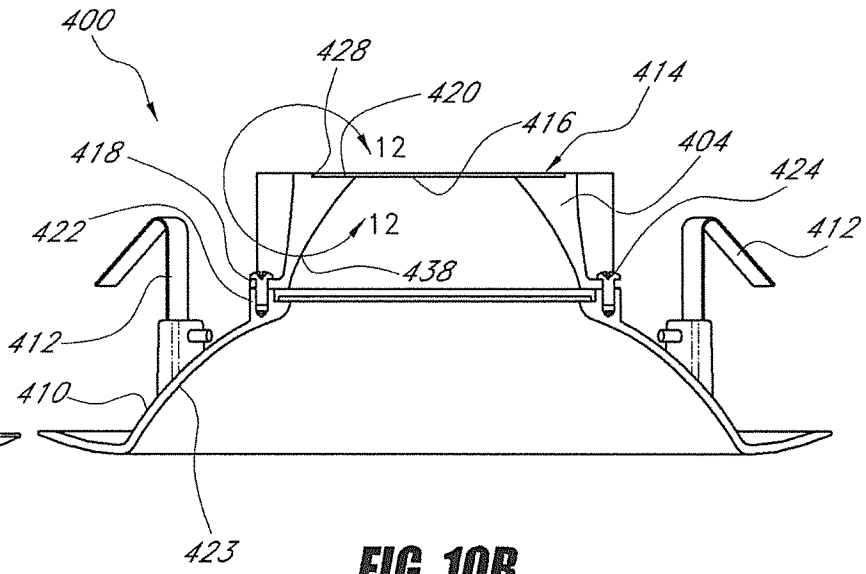
FIG. 10B is cross-sectional view of the embodiment of the light engine from FIG. 10A taken along line 10B-10B.
Figure 10A:
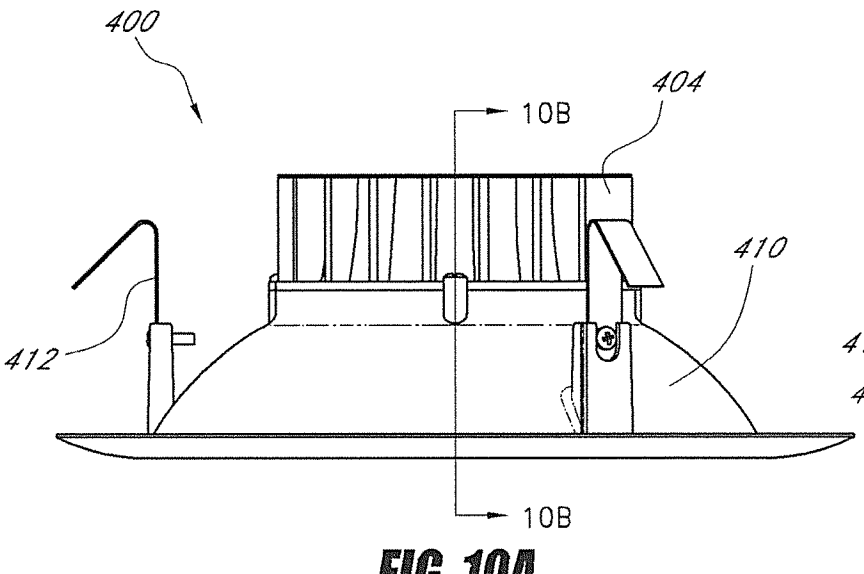
FIG. 10A is another embodiment of a light engine.
Figure 11:
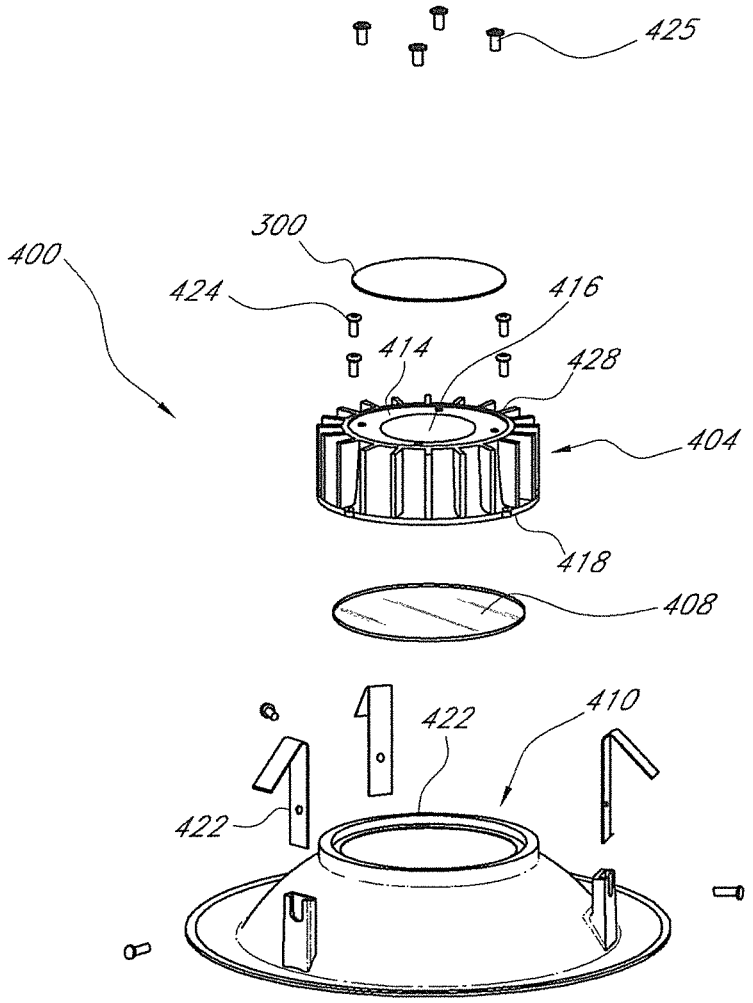
FIG. 11 is an exploded view of the light engine of FIG. 10A.
Figure 12:
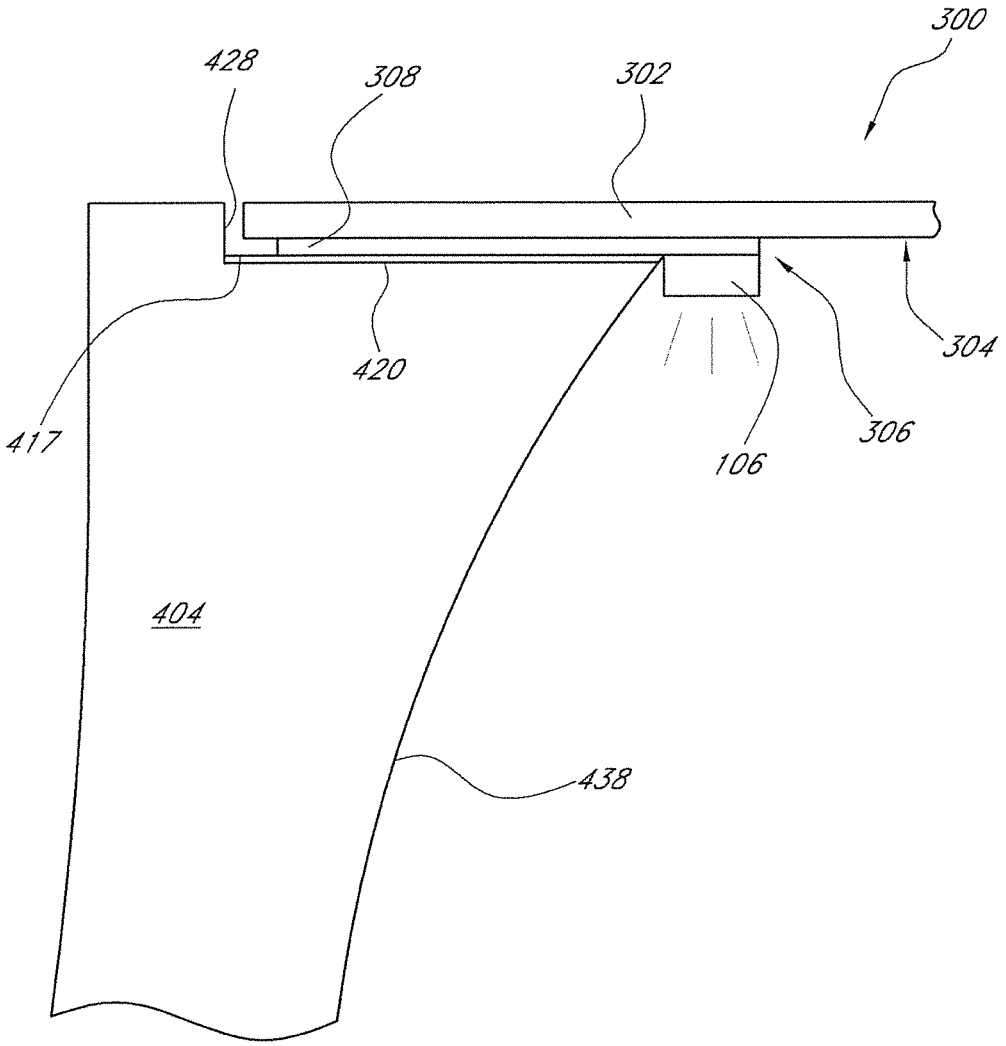
FIG. 12 is a cross-sectional view of a portion of the embodiment of FIG. 10A taken along line 12-12.

With reference next to FIGS. 10-12, an embodiment of a light fixture 400 employing, in one embodiment, the LED module 300 of FIGS. 8 and 9 is illustrated. In this embodiment, the LED fixture 400 comprises a housing 404 made of a heat conductive material, such as aluminum, and having structure for efficiently transferring heat to the environment. For example, in the illustrated embodiment, the housing 404 comprises fins 406. The illustrated housing 404 has a cavity 414 sized and adapted to accommodate the LED module 300. The cavity 414 is defined by an engagement surface 420 and a circumferential wall 428. An aperture 416 is formed through the housing 404 and extending through the engagement surface.

The cavity 414 is configured so that the LED module 300 fits therein with the outer plates 308 of the front face of the circuit board 302 engaged with the engagement surface 420 and the LEDs aligned with the aperture 416. Preferably, an electrically-insulative material 417 is disposed between the engagement surface 420 and the plates 308. Preferably, such material is comparatively thin and most preferably has good heat conductance properties so that heat from the plates will readily flow through the layer and into the housing 404 through the engagement surface 420, but the plates 308 will be electrically insulated from the housing 404. In the illustrated embodiment, the inner portion, or insulated zone 304, of the circuit board 302 does not contact the housing 404. Thus, heat from the LEDs 106 that is communicated to the plates 308 and further to the housing 404 is not communicated to the inner portion 304. Most specifically, a heat pathway is established from the LEDs 106 away from the inner portion 304 to the plates 308, and further to the housing 404 for dispersal to the environment.

In the illustrated embodiment, the aperture 416 in the housing 404 preferably leads to a bowl-shaped portion 438 adapted to direct light in desired direction. The housing has a flange 418. A trim piece 410 preferably has a complementary flange 422 and a further light-directing bowl 423. The housing and trim piece flanges 418, 422 are preferably engaged so as to attach the housing 404 to the trim piece 410, thus constructing an attractive and effective luminaire. Preferably the trim piece is constructed of a heat-conductive material, and tightly engages the housing so as to further assist in heat dispersal to the environment. Mounts 412 may be provided for mounting the luminaire as desired.

In the illustrated embodiment, a lens 408 is provided in a space between the housing 404 and the trim piece 410. Fasteners 424 such as bolts preferably attach the trim flange to the housing flange. Bolts 425 can also be employed to attach the circuit board body 302 to the housing 404. In other embodiments, the circuit board 302 may be attached by an adhesive. Preferably, such an adhesive would be electronically nonconductive, but would allow heat to flow from the circuit board 302 to the housing 404.

In the illustrated embodiment, and as best shown in FIG. 12, the plates 308 on the front side of the circuit board 302 thermally engage the engagement surface 420 of the housing 404. Thus, heat from the LEDs is directed away from the insulated zone 304 of the circuit board 302 and to the plates 308 and further from the plates into the housing 404, which absorbs thermal energy like a heat sink and also disperses heat to the surrounding environment. Notably, in this embodiment heat is never transferred from the front face to the back face of the circuit board 302 and, in fact, the illustrated circuit board embodiment is made of a material that is heat isolative so as to prevent or substantially resist such heat transfer.

In another embodiment, the housing is configured to include a trim portion integrally formed therewith. The housing and its associated trim portion can be configured into various shapes and sizes, and may or may not include a cavity for mounting the LED module.

In each of the above-discussed embodiments, the circuit board is circular, as is the housing cavity, which preferably is specially configured to accommodate the circuit board. It is to be understood that, in other embodiments, circuit boards having various shapes and sizes may be employed as desired, while still practicing inventive principles as disclosed herein.

Figure 13:
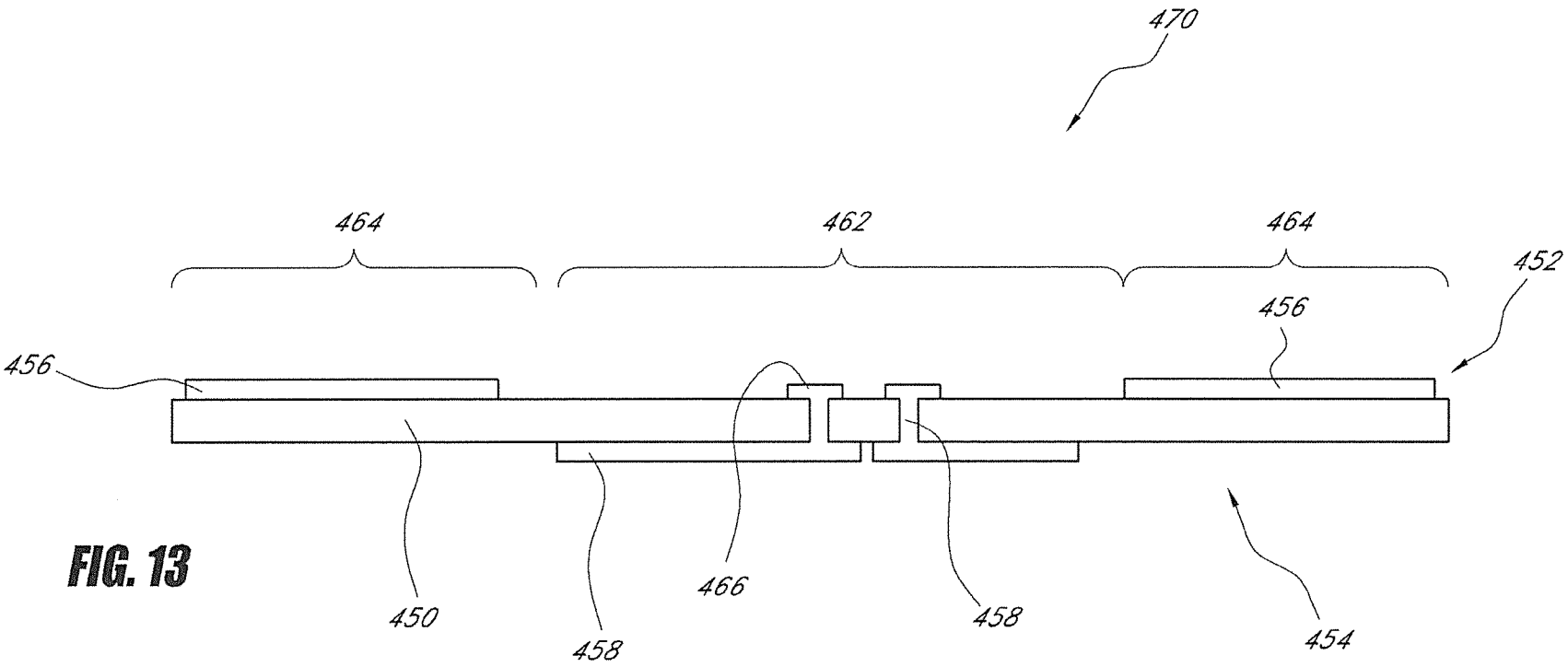
FIG. 13 is a cross-sectional view of another embodiment of an LED module.

With reference next to FIG. 13, another embodiment of an LED module 470 having a circuit board 340 with opposing first and second faces 452, 454 and having a configuration on its first face 452 having a heat insulated inner zone 462 and a heat-generating and communicating outer zone 464 as in the LED module 300 discussed above. However, this embodiment further provides one or more heat conducting plates 458 on the second side 454 of the circuit board 450, but spaced from and not overlapping the first side plates 456. Instead, the second side plates 458 are opposite to and generally correspond to the first or insulated zone 462 of the circuit board 450. In one embodiment, certain components in the first zone 462 on the first side 452 of the circuit board 450 may generate heat. In the illustrated embodiment, conductive vias 460 extend from conductive pads 466 corresponding to such heat-generating components through the circuit board body 450 to the plates 458 on the second side 454 of the board 450.

Since there is no substantial heat pathway between the plates 456 on the first side of the board 452, which are associated with the LED heat, and the plates on the second side of the board 454, which are associated with the first zone heat 462, the heat from a second or heat management zone 464 and the heat from the first zone 462 is managed separately, along generally independent heat pathways. This is particularly beneficial when the heat generated in the second zone 464 (such as by the LEDs) is substantially greater than the heat generated by componentry in the first zone 462, because managing such heat-generating components in common could result in componentry of the first zone 462 being exposed to greater temperatures because of common heat management with the LEDs. In another embodiment, a separate heat management system for the insulated zone may be used even if the componentry does not generate substantial heat on its own.

In the illustrated embodiment, there is substantially no overlap between the plates 456 on the first side 452 of the circuit board 450 and the plates 458 on the second side 454 of the circuit board 450. In other embodiments, there may be overlap, but the opposing plates are still insulated relative to one another by the heat-insulative thickness of the circuit board.

Figure 14B:
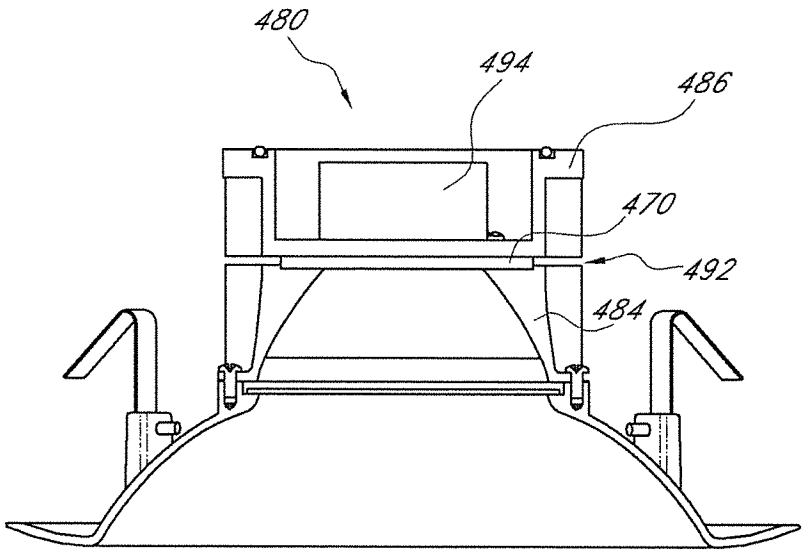
FIG. 14B is cross-sectional view of the light engine from FIG. 14A taken along line 14B-14B.
Figure 14A:
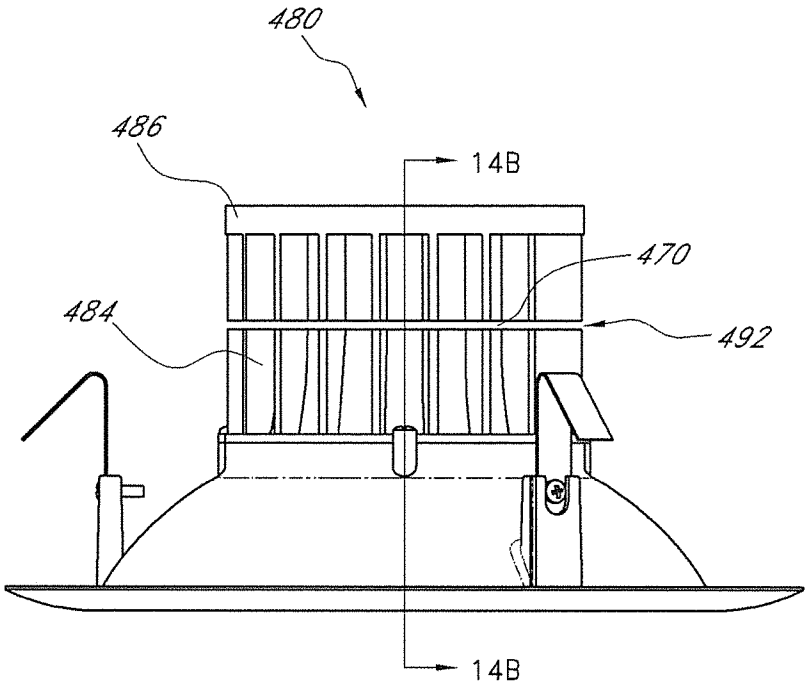
FIG. 14A is another embodiment of a light engine.

FIG. 14 illustrates an embodiment of a luminaire 480 configured for use, in one embodiment, with the circuit LED module 470 of FIG. 13. As can be seen, FIGS. 14 and 15 employ a first housing 484, having a cavity 485 into which the LED module 470 is placed. A second housing 486 is mounted onto the back of the LED module 470. Preferably, the second housing 486 engages the second side plates 458 so that heat from the first zone 462 flows to the back plates and further flows to the second housing 486. Preferably, the second housing 486 is made of a heat conductive material such as aluminum and includes heat transfer structure such as fins 496 in order to efficiently transfer heat to the environment. As in the embodiment discussed above in connection with FIGS. 8-12, the first side of the circuit board is mounted on and communicates heat to the first housing 484.

Preferably, and as shown in FIG. 14, there is a space 492 between the first and second housings 484, 486 so that they do not contact one another, and thus do not communicate directly with one another. More specifically, heat received by the first housing 484 from the LEDs is not directly communicated from the first housing 484 to the second housing 486, and vice versa. Instead, heat from components in the first zone 462 is communicated along a heat pathway through the vias 460 to the second side plate(s) 458, and further to the second housing 486, which absorbs heat as a heat sink and also disperses such heat in the environment. As such, heat transfer systems for the second zone 464 and the first zone 462, which are on the same circuit board 450 but substantially insulated relative one another, are managed separately, and without intersecting heat pathways between the heat-generating components and the environment.

Figure 15:
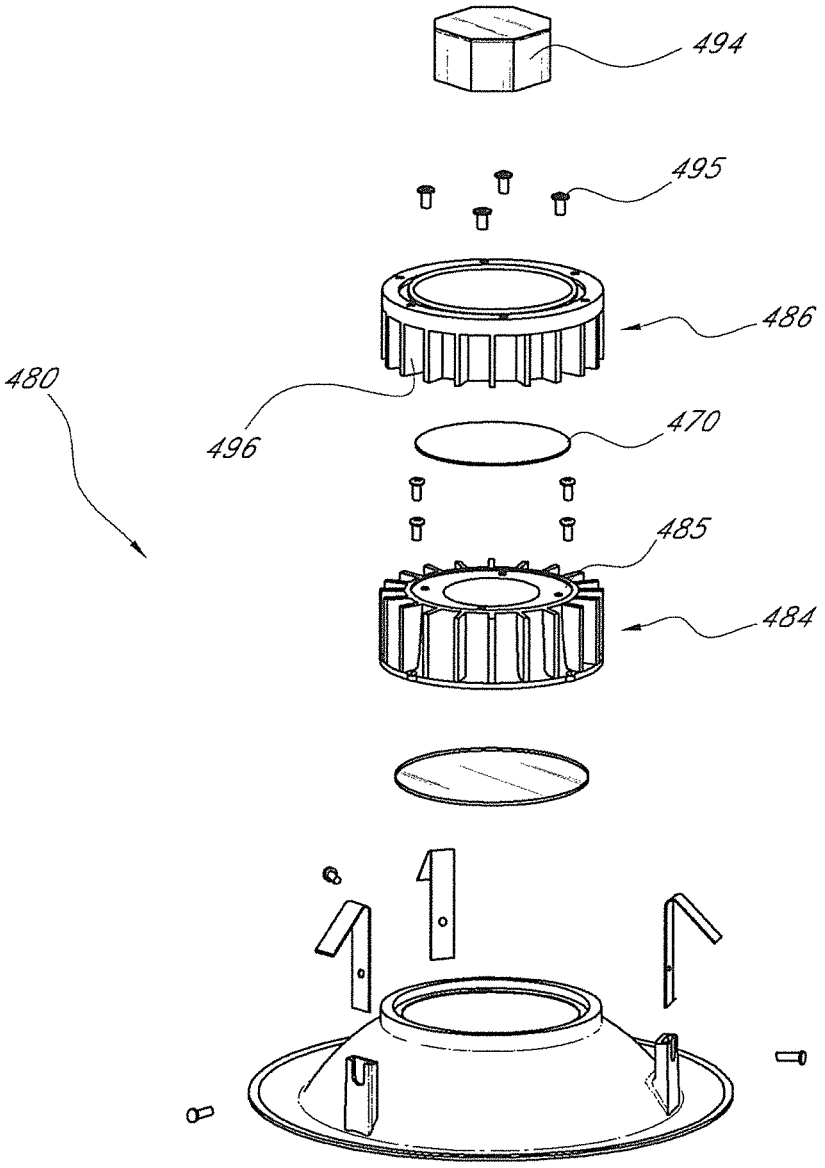
FIG. 15 is an exploded view of the light engine from FIG. 14A.

FIGS. 14 and 15 additionally contemplate provision of a power driver 494, which can condition power prior to that power being supplied to the LED module 470. In the illustrated embodiment, the power driver 494 is mounted on or in the second housing 486, so that the second housing additionally provides heat evacuation from the power driver 494. It is to be understood that other embodiments may not provide such a power driver 494 that shares heat transfer management with the inner portion, or any other portion of the LED module 470. Additionally, in the illustrated embodiment the first and second housings 484, 486 are connected by bolts 495 that extend through the circuit board. It is to be understood that inserts may be provided for insulating such screws from the circuit board, and/or such bolts can comprise nonelectrically-conductive fasteners.

Figure 16:
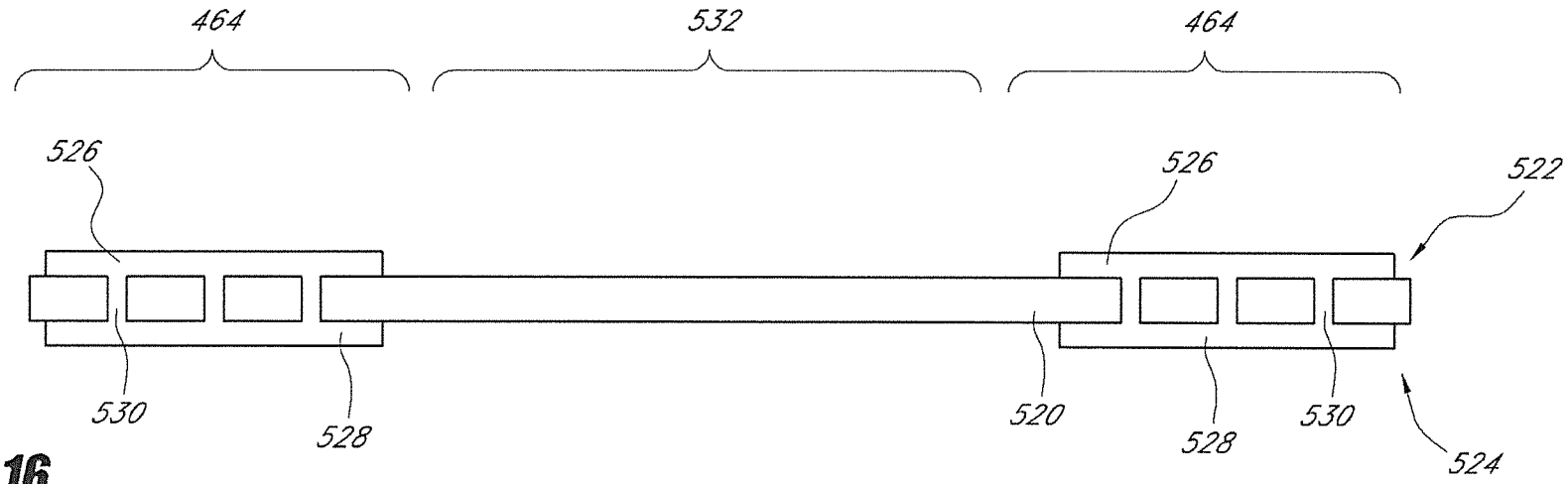
FIG. 16 is a cross-sectional view of another embodiment of an LED module.

With reference next to FIG. 16, another embodiment of an LED module 510 has a circuit board body 520 with a first side 522 having first, second and third plates 526 configured similar to the first, second and third plates 308 of the LED module 300 discussed above, and has a first zone 532 and a second zone 534 that are thermally insulated relative to one another. Plates 528 disposed on a second side 524 of the circuit board body 520 generally correspond to the first, second, and third plates 526 of the first side 522. Conductive vias 530 are provided through the circuit board 520 so as to conduct heat from the plates 526 on the first side 522 to the corresponding plates 528 on the second side 524 of the circuit board 520. This effectively increases the heat transfer area of the plates and can be effective for increasing the heat transfer ability of the circuit board's heat zone.

In the illustrated embodiment, preferably no heat conductive plate is disposed opposite or overlapping the first or insulated zone 532 of the circuit board 520. This in addition to the heat-insulative character of the circuit board material itself, helps assure that the first zone 532 is insulated from heat generated by the LEDs and communicated to the second or heat management zone 534 of the board. In another embodiment, the back plates may overlap portions of the insulated zone. However, the heat-insulative circuit board material is still disposed between the plates and the insulated zone.

The embodiments of FIGS. 13-15 were just discussed in connection with an LED module 470 having front plates and back plates that each evacuate heat from different components and which do not substantially overlap or conduct heat between each other. In other embodiments, housings such as that of FIGS. 14 and 15 can be employed with an LED module 510 as depicted in FIG. 16, in which heat from the outer, second zone 534 is evacuated simultaneously from both faces 522, 524 of the circuit board 520. In such embodiments, the first and second housings 484, 486 may or may not be configured to directly contact one another as desired.

Figure 17:
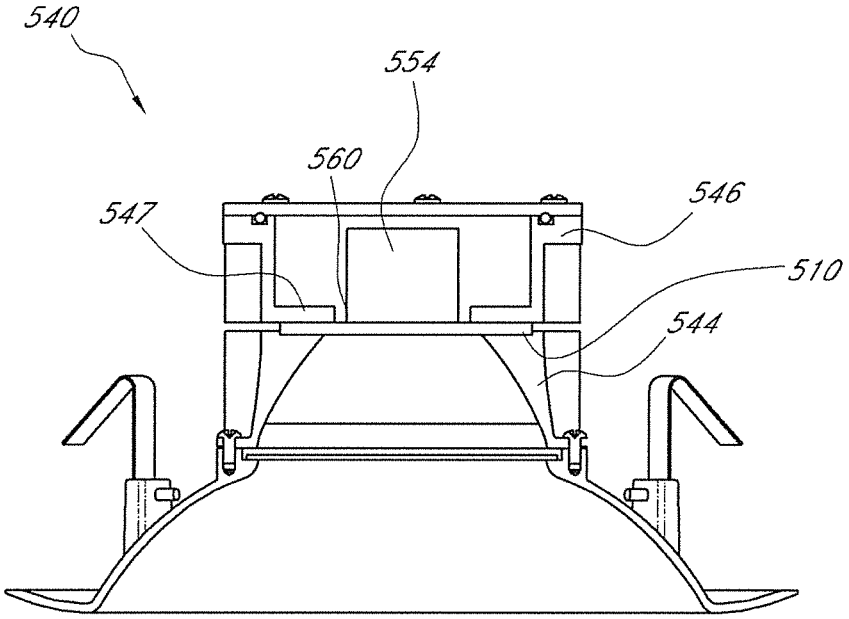
FIG. 17 is a cross-sectional view of another embodiment of a light engine.

With reference next to FIG. 17, another embodiment of a luminaire 540 configured for use with the LED module 510 of FIG. 16 is shown in cross-section. As can be seen, the luminaire 540 employs a first housing 544 and a second housing 546 between which the circuit board 520 is sandwiched. The second housing 546 has a front wall 547 having an aperture 560 formed therethrough. Preferably, the front wall 547 of the second housing 546 engages the second side plates 528 so that heat from the heat management zone 534 flows from the back plates 528 to the second housing 546. As in the embodiment of FIGS. 14-15, heat from the front plates 526 flows into the first housing 544.

In the illustrated embodiment, a power driver 554 extends through the aperture 560 in the second housing 546 and directly engages the circuit board 520. Though mounted to the same circuit board 520 on which the LEDs are mounted, preferably the power driver 554 communicates initially with componentry in the first, or insulated zone 532, and is thus insulated from heat generated by the LEDs. Since the power driver 554 also does not contact either housing 544, 546, it is isolated from the heat path from the LEDs to the housings 544, 546.

Figure 18:
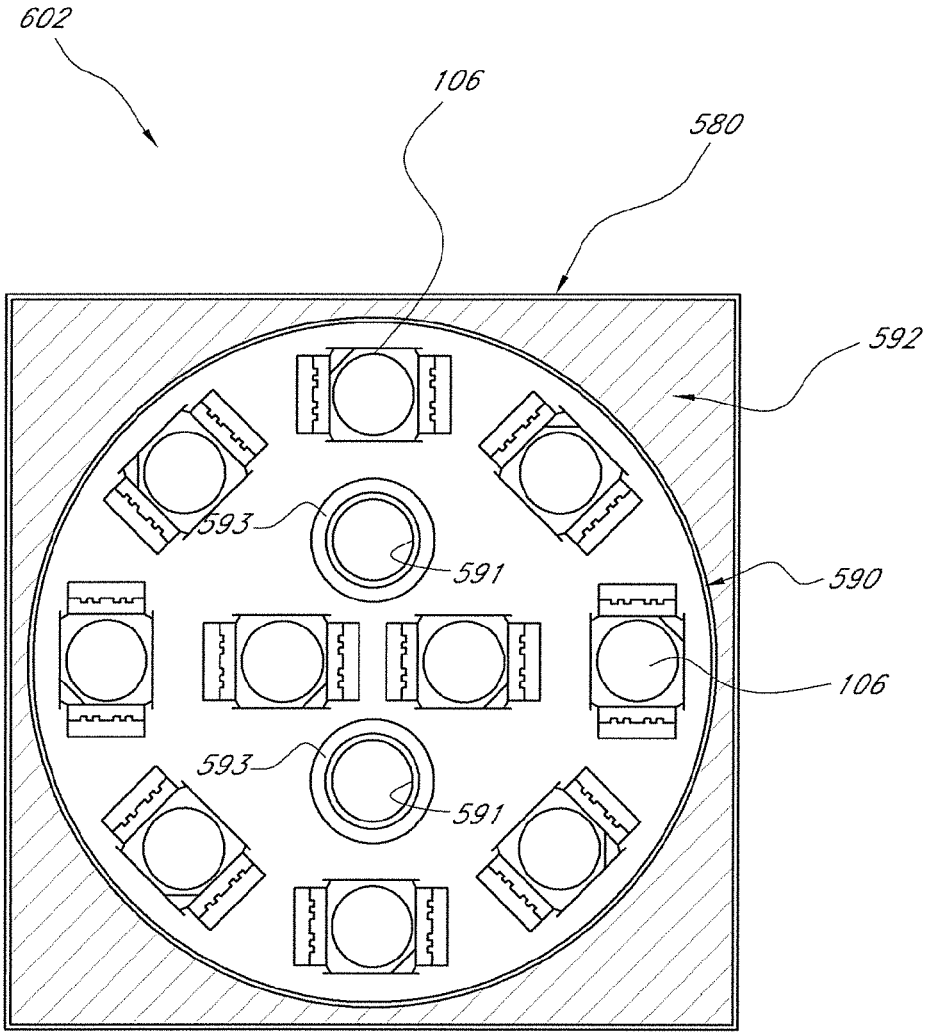
FIG. 18 shows another embodiment of an LED module.

With reference next to FIG. 18, another embodiment of an LED module 602 is illustrated. In the illustrated embodiment the LED module 602 has a circuit board body 580 that is generally square. Though not specifically shown in FIG. 18, the circuit board 580 preferably has conventionally configured circuit traces and componentry necessary to power a series of LEDs 106. The circuit board 580 has a generally circular first zone 590 that contains the circuit traces and LEDs. A second zone 592 extends from the edges of the circuit board 580 to the first zone 590. In other embodiments, the first zone can have other geometric shapes, such as oval or square, as desired.

In one embodiment, the circuit board body 580 is a heat-conductive material such as aluminum. In the first zone, a thin dielectric layer is disposed on a first, or front, face of the aluminum body 580, and a circuit comprising a plurality of conductive traces, such as copper traces, contact pads, plates and the like is defined on the dielectric layer so as to be electrically insulated from the conductive aluminum body 580. A plurality of LEDs 106 is mounted on the conductive traces so as to complete a circuit.

A pair of apertures 591 is formed through the body 580 in the first zone 590. Preferably a conductive contact pad 593 surrounds each aperture 591, and a circuit through the LEDs 106 is defined between the pads 593 so that power provided across the pads 593 supplies power to the LEDs 106.

As the body 580 in this embodiment is aluminum, it readily accepts heat flowing from the LEDs 106 to associated traces, through the dielectric layer and to the body 580, which can function as a heat sink. Preferably the dielectric layer is configured to electrically insulate the traces, but facilitates heat flow therethrough. Also, preferably the second zone 592 of the first face and a second, or back, face of the body are configured to facilitate heat transfer to the environment or one or more adjacent heat sinks. Most preferably, the second zone and the second face are substantially uncoated, bare aluminum so as to minimize resistance to heat transfer to an engaged surface. In other embodiments a thin thermal pad such as a silicone gasket can facilitate adhesion between surface and/or can enhance surface contact for rough-surfaced metal surfaces.

Figure 19:
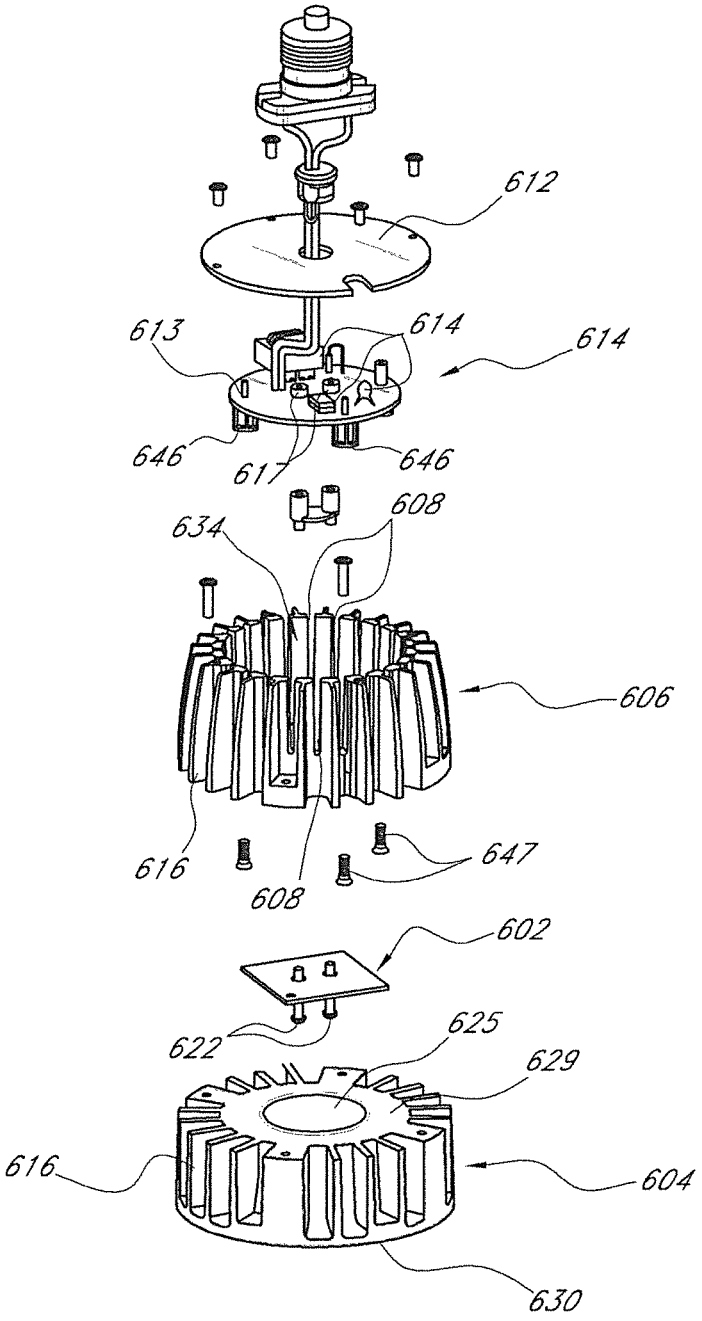
FIG. 19 is an exploded view of another embodiment of a light engine.
Figure 20:
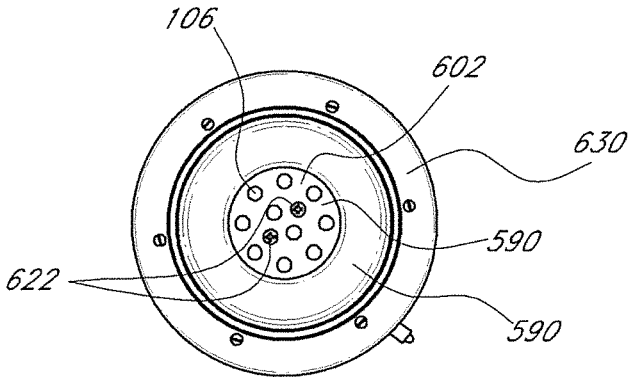
FIG. 20 shows the light engine of FIG. 19 from a view looking toward a light output side.
Figure 21:
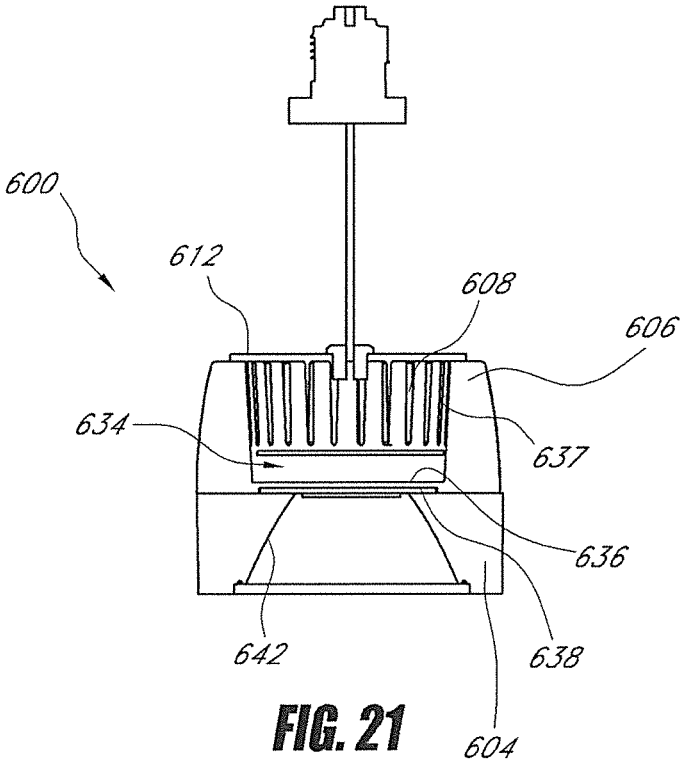
FIG. 21 is a side sectional view of the light engine of FIG. 19.

FIGS. 19-21 show views of a light engine 600 using the LED module 602. The light engine 600 comprises a first housing 604, a second housing 606, an LED module 602, and a power conditioner 614. The illustrated light engine 600 is configured to use the LED module 602 described above in FIG. 18. Preferably both the first and second housings 604, 606 are formed of a heat-conductive material, such as aluminum. As such, both housings can function as heat sinks. Both illustrated housings 604, 606 comprise fins 616 to help transfer heat to the environment. It is to be understood that other structures that facilitate heat transfer may be employed in addition to or instead of fins.

The first housing 604 comprises a flange 630, or circular rim, adapted to complement and engage a decorative trim, which may be similar to the trim illustrated in FIG. 8. In some embodiments a lens may be arranged between the first housing 604 and the trim. An aperture 628 is formed longitudinally through a back face 629 of the first housing 604 and provides access so that light from the LEDs on the LED module 602 will be directed into a bowl portion 642 and out of the light engine 600. Preferably, the first zone 590 and aperture 628 are sized so that the first zone 590 fits fully within the aperture 628, and no part of the first zone 590 contacts the front housing 604.

A compartment 634 is formed in the second housing 606 having a front wall 636 and a circumferential wall 637. A plurality of spaced-apart longitudinal slots 608 are formed through the wall 637 between successive fins 616 about the circumference of the compartment 634. A plurality of apertures (not pictured) extends through the front wall 636. A cavity 638 is also formed on the front wall 636 of the second housing 606. The cavity 638 is defined by a cavity surface and a surrounding circumferential cavity wall. The cavity wall preferably is sized to accommodate at least a portion of the thickness of the LED module 602.

The second housing 606 fits generally behind the first housing 604 and, preferably, is aligned therewith. The LED module 602 thus is sandwiched between the back face 629 of the first housing 604 and the front wall 636 of the second housing 606. Preferably substantial compression is exerted on the LED module 602, so that conductive faces of the module 602 fit tightly against the housing surfaces 629, 636, thus providing a more efficient and effective heat transfer junction between the module 602 and the housings 604, 606. It should also be noted that because the LED module 602 is formed from a conductive material, no adhesive is necessary to engage the LED module 602 with the first and second housings 604, 606, and preferably no dielectric layer is disposed on either the second zone 592 of the body 580 front face or on the second face of the body. As such, when the module 602 is sandwiched between the housings 604, 606, the aluminum body 580 makes metal-to-metal contact with opposing housing surfaces 629, 636.

Preferably, a power conditioner 614 is disposed in the compartment 634 in the second housing 606. The power conditioner 614 comprises componentry 615 that conditions input power into a form palatable for LEDs and supplies the power across power nodes 617. For example, in one embodiment the power conditioner receives 120 VAC wall power and transfers it into a DC current of 9V, 10V, 12V or the like, as necessary for the LEDs on the LED module. The power conditioner can also be configured to perform other functions with regard to power delivery, such as varying current or voltage to affect LED brightness.

In the illustrated embodiment, the power conditioner 614 does not have its own separate enclosure; rather, the components 615 are mounted on a circuit board 613. The circuit board 613 employs spacers 646 that electrically isolate the board from the second housing 606, thereby preventing a short from occurring between the power conditioner 614 and the second housing 606. Preferably, the spacers 646 are formed from a material that is not substantially heat conductive, and thus also thermally isolate the board 613 from the second housing 606. Preferably the board 613 fits within the compartment 634 so that it does not contact the wall 637.

Preferably, conductive bolts 622 extend through the apertures 591 in the LED module 602 and through apertures in the wall 636 of the second housing 606 to engage the power nodes 617 on the power conditioner 614. Preferably the heads of the bolts 622 engaged the contact pads 593, so as to supply power from the nodes 617 to the circuit on the LED module 602. A bolt guide 619 preferably accommodates the shanks of the bolts 622 through the space between the module 602 and the power conditioner 614 so as to electrically insulate the bolts from the housing. The mechanical and electrical configuration and interaction between the bolts and the module preferably shares similarities with the embodiments disclosed in copending U.S. application Ser. No. 11/434,663, filed May 15, 2006, which is owned by the assignee of the present application, and which is incorporated by reference in its entirety, particularly the disclosure relating to metal-core LED modules and supply of power from a power driver to LED modules by way of fasteners.

With continued reference to FIG. 18-21, a plate 612 preferably encloses the compartment 634 of the second housing 606. The compartment 634 is ventilated by the longitudinal slots 608, which facilitate heat transfer between the power conditioner 614 and the environment. In some embodiments, the second housing 606 may be substantially sealed from the environment.

Figure 22:
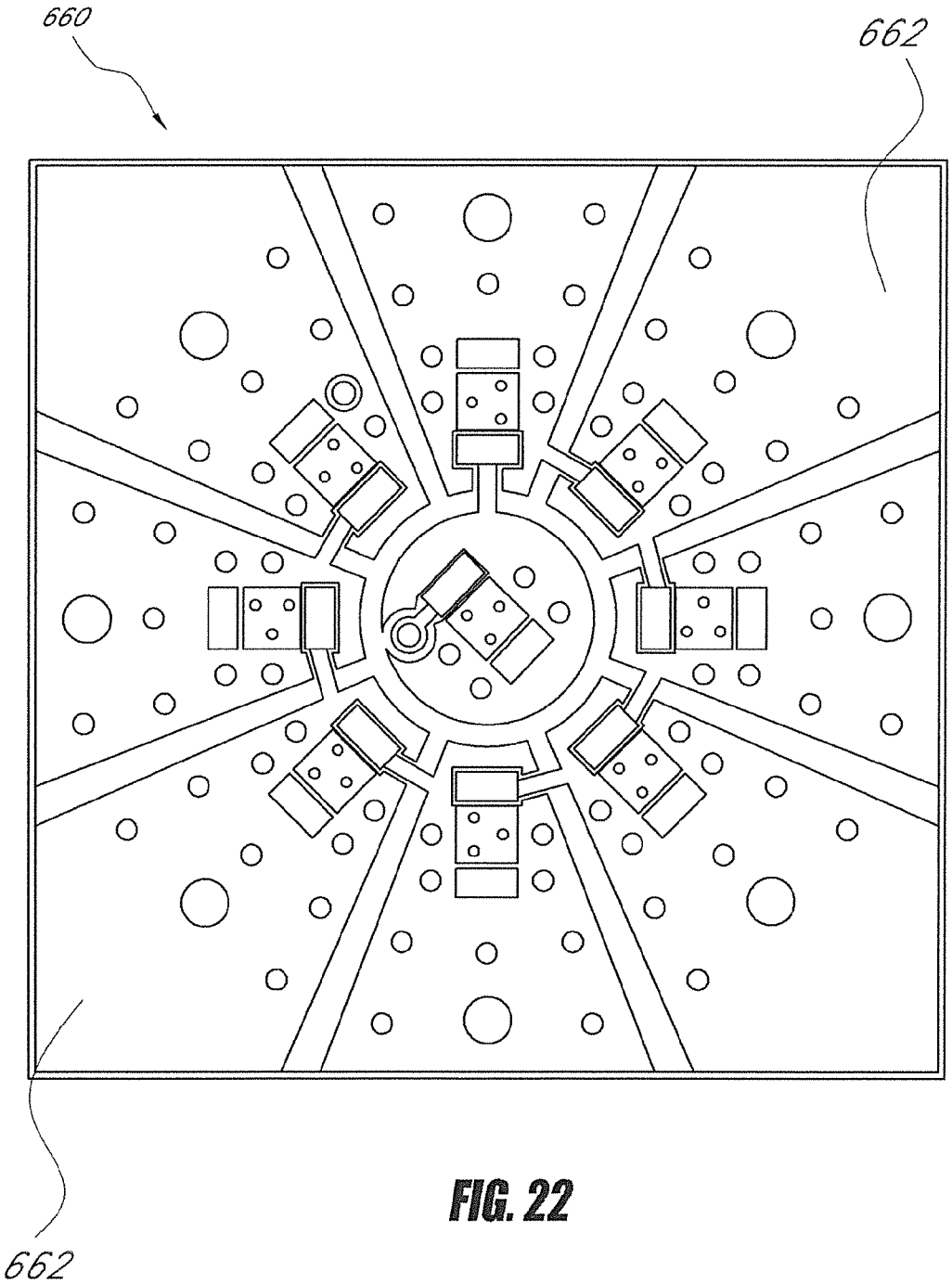
FIG. 22 is another embodiment of an LED module.
Figure 23:
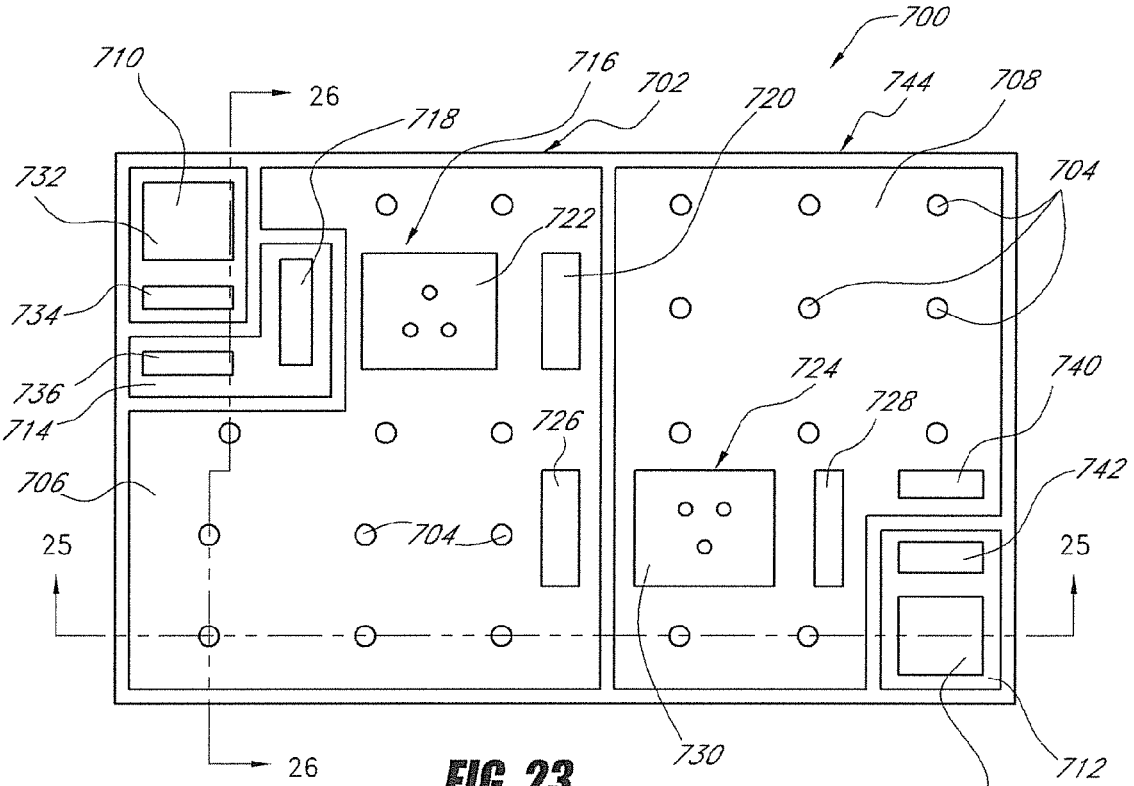
FIG. 23 is a front-side view of a circuit board for use with another embodiment of an LED module.

FIG. 22 illustrates another embodiment of an LED module 660. In the illustrated embodiment, the module 660 maintains substantially the same layout and componentry, which includes the same leads, pads, traces, plates, and electrical layout, as the LED module 202 discussed above in connection with FIG. 1. However, the shape of the module 660 illustrated in FIG. 22 is square or rectangular. As such, the plates 662 are elongated in order to extend to the edge of the circuit board. In another embodiment, the square-shaped LED module 660 may be used with the light engine 600 in place of LED module 602.

With reference again to FIGS. 1-3 in a preferred embodiment, the LED packages 106 are soldered into place on corresponding LED mounts 70. More particularly, during manufacture of the LED module 202 in accordance with a preferred embodiment, the LEDs 106 are put in place by a conventional "pick and place" machine which, as the name implies, picks up LED packages from a source and robotically places them at their appropriate positions on the LED mount 70. During the manufacturing process, the entire board preferably is drawn through an oven, which is kept at a temperature at which solder on the contact pads 64, 72, 74 melts sufficient that the LED packages 106 are soldered into place. Preferably, the oven temperature is tightly controlled during soldering so as to not exceed a temperature that could damage any components that are to be placed on the board 52, such as the dies of the LEDs. In other embodiments, other types of electrical components, such as EEPROM chips used to control certain power delivery functions, electrical jumpers, or other components for conditioning or delivering power, may also be placed by a "pick and place" machine and soldered into place by being drawn through an oven.

Although certain componentry such as LEDs and integrated circuit chips are typically placed and soldered onto circuit boards through the "pick and place" machine and oven soldering procedure discussed above, typically such circuit boards are attached to power delivery wires after the LED module has been initially manufactured. For example, power delivery wires may not be soldered into place until an LED module 202 is place on a housing 102.

In some embodiments employing thermally managed configurations, it can be difficult to heat a contact pad sufficient to melt the solder so as to attach a power wire or the like because heat is evacuated from the contact pad faster than it can be added by a soldering iron. Also, in some instances, heat from soldering may be communicated to components mounted onto the circuit board. As such, soldering a component such as a wire to the circuit board outside of an oven can be difficult, time-consuming, and may require expensive materials and/or specialized, complex procedures.

Hand-soldering presents issues not encountered in the oven soldering process. During the oven soldering process, heat transfer away from the solder contact pads is not a problem because the entire circuit board is heated to the same temperature, and thus there is no substantial heat transfer between pads and plates.

In a preferred embodiment, a power contact pad or other pad to which a component is soldered is disposed on a plate or contact that has only limited heat transfer opportunity or ability. For example, with continued reference to FIGS. 1 and 3, the first plate 68*a* generally surrounds the power input contact pad 58 but does not electrically or thermally communicate therewith. Instead, the power input contact pad 58 communicates only with the first lead 76*a* and associated first connector pad 72*a*. In fact, the power input contact pad 58 is insulated, electrically and thermally, relative to the first front plate 68*a*. Thus, in this embodiment, heat applied by a soldering iron when hand-soldering (or otherwise soldering after the oven-soldering process) a wire to the power input contact pad is mostly retained on the insulated power input trace 76*a*. Heat accumulates quickly to melt the solder, and thus soldering can be completed quickly in a normal fashion.

With reference next to FIGS. 23-27, another embodiment of an LED module is illustrated. The illustrated embodiment comprises an LED module 700 made up of a printed circuit board 702 upon which a pair of LEDs may be arranged electrically in series. The circuit board 702 comprises a conventional core, such as FR4, having a first face 744 and an opposite second face 745. A first power supply plate 710 is disposed on the first face 744 adjacent one corner. A first power supply contact pad 732 and a first component contact pad 734 are defined on the first power plate 710 with the first component pad 734 disposed adjacent the first power contact pad 732 and adjacent an edge of the first power supply plate 710. Similarly, a second power supply plate 712 is disposed on the front face 744 adjacent an opposite corner of the circuit board 702. A second power supply contact pad 738 is disposed on the second power plate 712, and a second component contact pad 742 is disposed on the power supply plate adjacent the second power contact.

Continuing with reference specifically to FIGS. 23-27, a transition plate 714 and first and second LED plates 706, 708 are also disposed on the front side 744 of the circuit board body 702. In the illustrated embodiment, the transition plate 714 comprises a component contact pad 736 arranged generally opposite the first component pad 734 on the first power plate 710. The transition plate 714 also includes a first connector pad 718 of a first LED mount 716. A slug pad 722 and a second connector pad 720 of the first LED mount 716 are disposed on the first LED plate 706. The first LED plate 706 also includes a first connector pad 726 of a second LED mount 724. The second LED plate 708 comprises a slug pad 730 and a second connector pad 728 of the second LED mount 724. A component pad 740 is disposed on the second LED plate 708 so as to be opposite the second component pad 742 on the second power supply plate 712.

Figure 24:
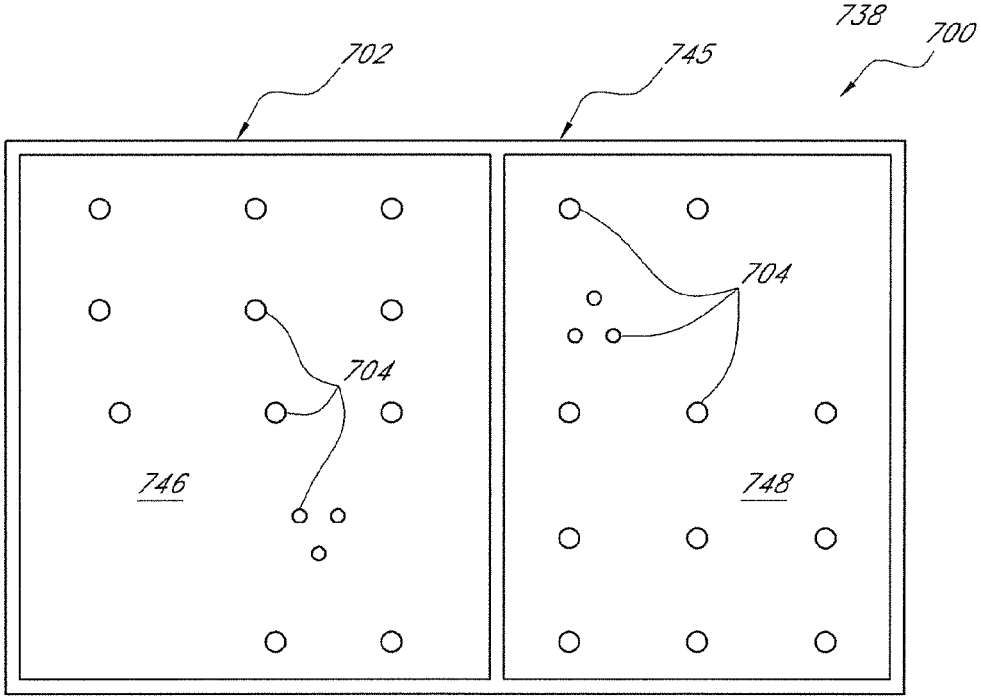
FIG. 24 is a back-side view on the embodiment of FIG. 23.
Figure 25:
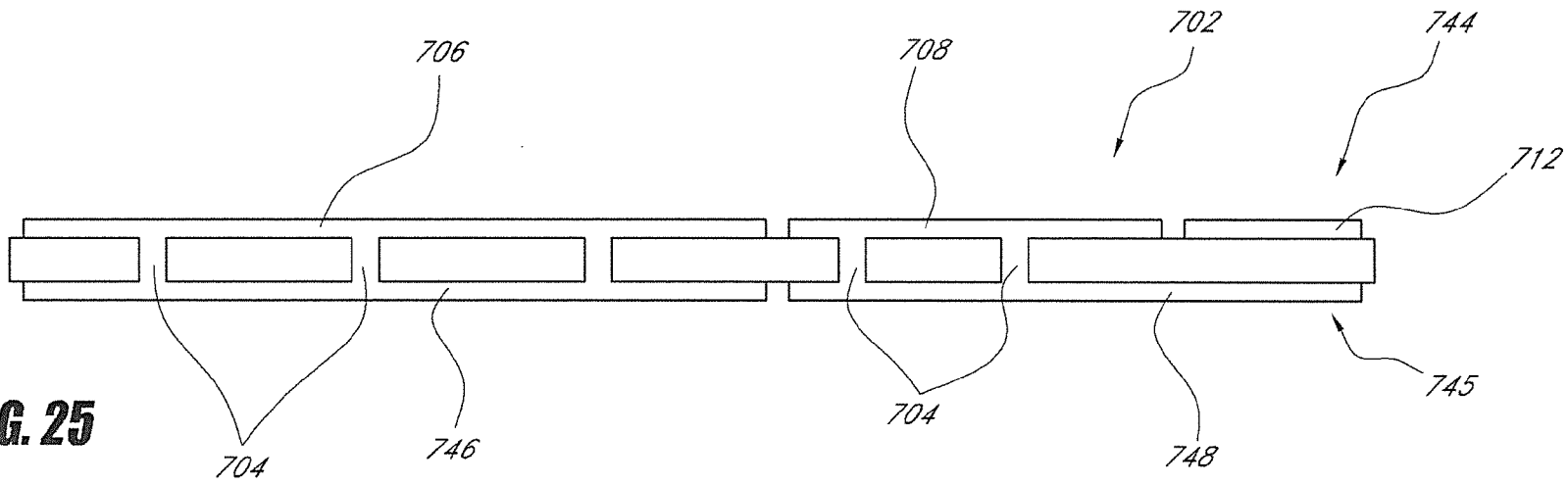
FIG. 25 is a cross-sectional view of the embodiment of FIG. 23 taken along line 25-25.
Figure 26:
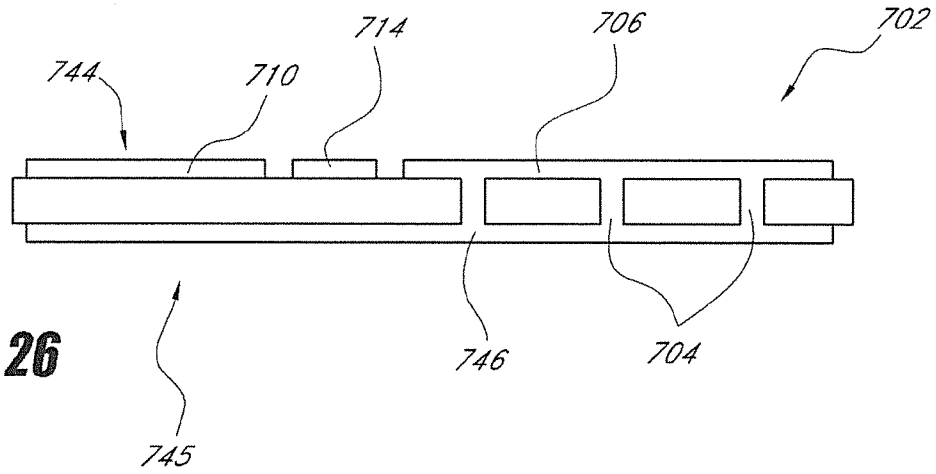
FIG. 26 is a cross-sectional view of the embodiment of FIG. 23 taken along line 26-26.

With additional reference to FIG. 24, the second face 745 of the circuit board 702 has first and second back plates 746, 748 formed thereon. The first back plate 746 generally corresponds to the first LED plate 706 and also the area generally opposite the first power plate 710 and the transition plate 714. The second back plate 748 generally corresponds to the second LED plate 708 and the area opposite the second power supply plate 712.

Figure 27:
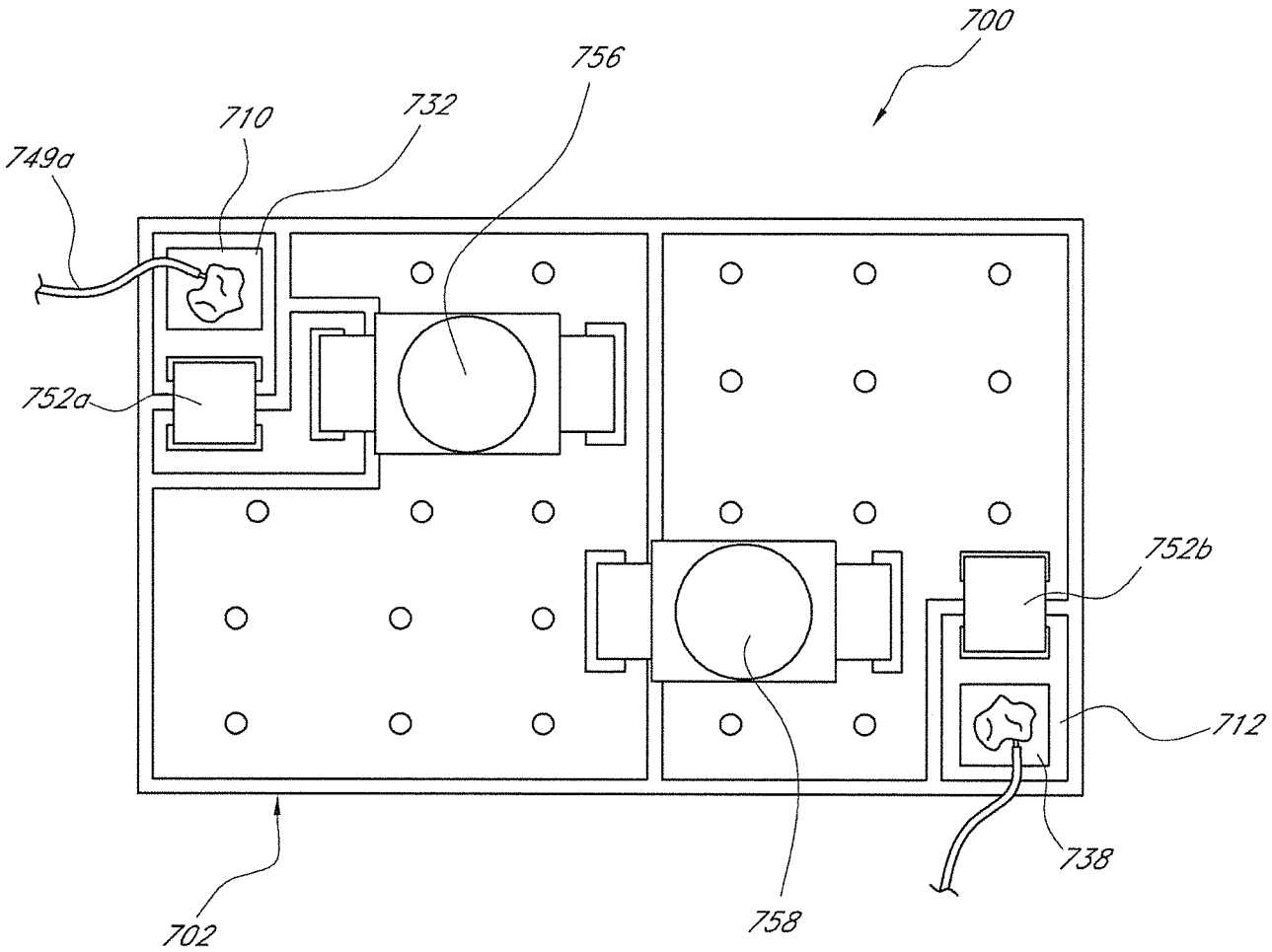
FIG. 27 shows an LED module using the circuit board of FIG. 23.

With particular reference to FIG. 27, in the illustrated embodiment, power supply wires 749*a*, 749*b* are soldered onto the first and second power contact pads 732, 738. Also, a jumper 752*a* is mounted to extend between the component pads of the first power plate 710 and transition plate 714. Another jumper 752*b* is mounted to extend between the component plates of the second power plate 712 and second LED plate 708. Such jumpers preferably perform no power conditioning function, nor do they communicate heat effectively. However, they readily communicate electric power between adjacent plates.

A first LED package 756 is mounted on the first LED mount 716 so as to extend electrically between the first connector pad 718 on the transition plate 714 and the second connector pad 720 on the first LED plate 706. Similarly, a second LED package 758 is mounted on the second LED mount 724 so as to extend between the first connector pad 726 on the first LED plate 706 and the second connector pad 728 on the second LED plate 708. Notably, the heat slug of the first LED package engages the slug pad 722 of the first LED plate, and thus heat generated by the first LED package is communicated to the first LED plate 706. Similarly, the heat slug of the second LED package engages the slug pad 730 of the second LED plate 708. As such, the majority of heat generated by the second LED package is communicated to the second LED plate. As shown in FIG. 27, the first and second LED packages are arranged electrically in series between the attached first and second power supply wires 749*a*, 749*b*.

With continued reference to FIGS. 23-27, preferably a plurality of heat-conductive vias 704 extend through the non-heat-conductive core between the first and second LED plates 706, 708 and the first and second back plates 746, 748, respectively. As such, heat generated by the first LED 756 is readily spread across the first LED plate 706 and first back plate 746, and heat generated by the second LED 758 is readily spread across the second LED plate 708 and second back plate 748. Preferably, there are no vias between any power plate and any of the back plates. Instead, the power plates are insulated to resist heat transfer to the other plates. In fact, in the illustrated embodiment, the power plates are thermally insulated from any LED or electric power-conditioning component.

In this arrangement each of the power supply plates 710, 712 is insulated relative to electrical components that could be damaged if exposed to the heat of hand soldering. Also, the power supply plates 710, 712 are disconnected from structure that would evacuate heat from the plate. As such, the plates retain heat, and wires can be hand-soldered to the power supply contact pads on the power supply plates quickly and easily and without subjecting any components to potential heat damage. Preferably, and as discussed above, the electrical components mounted on the LED module are installed using a pick-and-place machine and soldering oven, but leaving select contact pads such as the power supply contact pads, to later be soldered to power supply wires.

Figure 28:
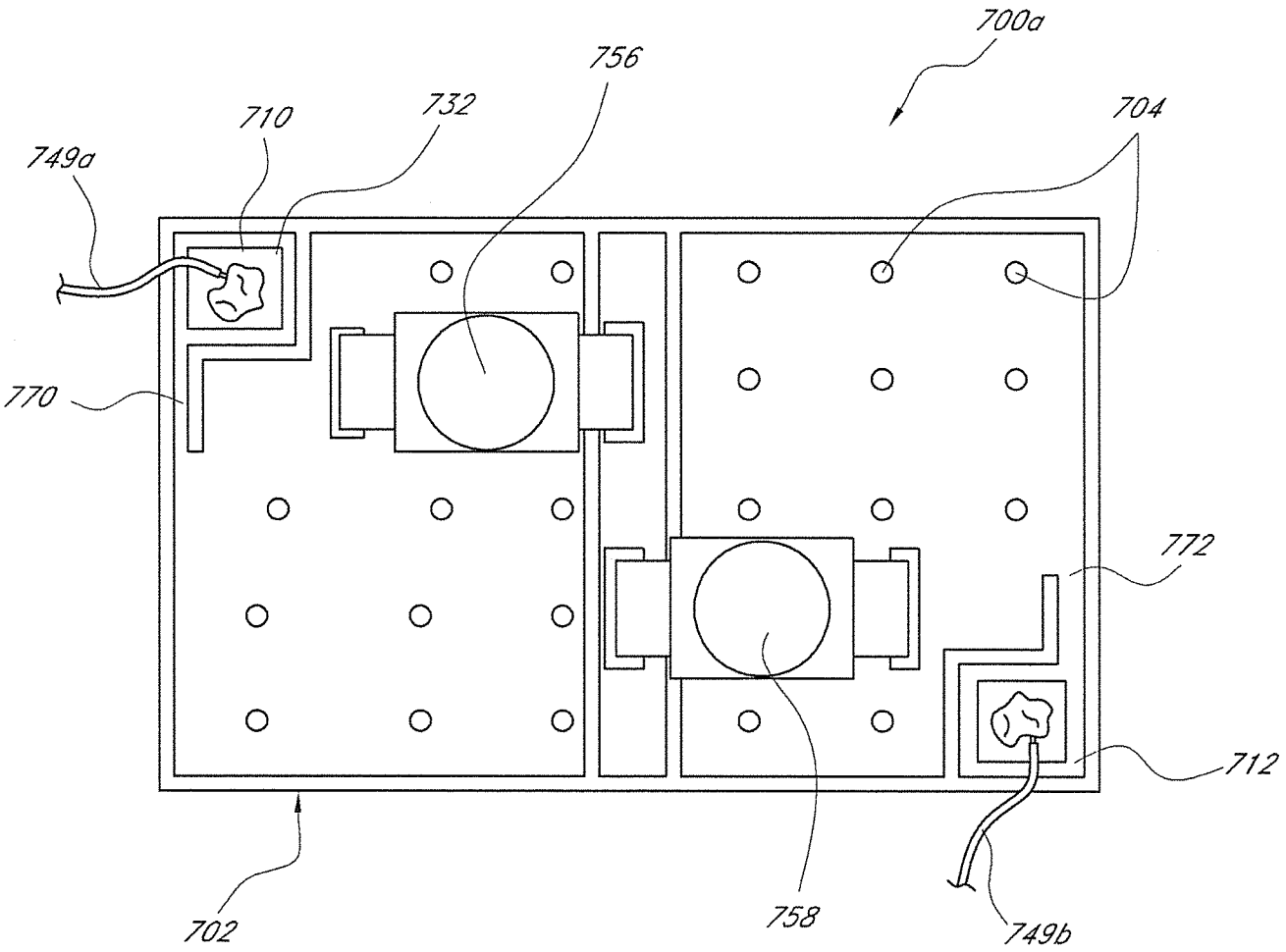
FIG. 28 shows a front-side view of another embodiment of an LED module.

With reference next to FIG. 28, another embodiment of an LED module 700*a* is provided, having much the same structure as the LED module 700 discussed above in connection with FIGS. 23-27. However, in this embodiment the front face 744 has only the first and second plates 706, 708. The first and second power supply plate portions 710, 712 are part of the first and second plates 706, 708, respectively, and are connected with the main part of the respective plates 706, 708 by relatively thin transition leads 770, 772. the transition leads 770, 772 readily conduct electricity from the power supply plate portions 710, 712 to the remainder of the respectively plates 706, 708. However, preferably the transition leads 770, 772 are sufficiently thin so as to slow communication of heat from the plate portions 710, 712 so that heat applied during soldering accumulates, facilitating soldering without transferring much heat to the remainder of the plates 706, 708.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. For example, the principles discussed in connection with FIGS. 23-28 can be employed in LED modules having configurations such as the module 202 of FIG. 1 or other ones of the modules. And LED modules of various configurations such as the embodiments shown in FIGS. 1, 7, 8, 13, 16, 18, 22, 23 and 28, can be modified to employ features of one another as appropriate. Such combinations can also be configured to work with various ones of the luminaires and housings described herein, which similarly can employ features of one another as appropriate. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A light engine, comprising:

a light emitting diode module comprising, a nonconductive substrate having a first side and a second side, the first side having a first region and a second region;

a plurality of conductive contact pads attached to the first side of the nonconductive substrate, and being positioned in the first region, a first plurality of thermally conductive plates attached to the first side of the nonconductive substrate, and being positioned in the second region, a plurality of light emitting diodes arranged in a circuit in the second region, a plurality of conductive circuit traces formed on the first side that communicate selectively with the plurality of conductive contact pads in the first region and the light emitting diodes in the second region, and a plurality of electrical components disposed on the plurality of contact pads in the first region, wherein the plurality of electrical components is thermally insulated from the plurality of light emitting diodes such that thermal energy generated by the plurality of light emitting diodes preferentially flows to the first plurality of plates in the second region; and a first housing formed of a thermally conductive material and having an aperture, the light emitting diode module mounted on the first housing so that light from the plurality of light emitting diodes is directed through the aperture;

wherein the first plurality of thermally conductive plates of the second region engage the first housing so that heat from the light emitting diodes is directed to the thermally conductive plates and further to the first housing.

2. A light engine as in claim 1, additionally comprising:

the light emitting diode (LED) module additionally comprising, a second plurality of thermally conductive plates attached to the second side of the nonconductive substrate, each of the second plurality of plates generally corresponding to a respective one of the first plurality of plates, and a plurality of thermally conductive vias extending through the substrate, wherein the plurality of vias are configured to transfer heat between respective ones of the first plurality of plates and the second plurality of plates, wherein heat generated by the plurality of LEDs is transferred to the first and second plurality of plates; and a second housing formed of a heat-conductive material and connected to the first housing so that the second plurality of plates is adjacent to and thermally connected to the second housing;

wherein the LED module is sandwiched between the first and second housings.

3. A light engine as in claim 2, wherein one of the first and second housings comprises a cavity adapted to accept the LED module therewithin, the cavity having a depth that is less than a thickness of the LED module substrate.

4. A light engine as in claim 2, wherein the first side has an inner zone and an outer zone, and wherein the plurality of LEDs in the second region are disposed in the inner zone, and the outer zone engages the first housing.

5. A light engine as in claim 2, wherein the first and second housings are connected so as to apply compression to the LED module mounted therebetween.

6. A light engine as in claim 5, wherein the second housing defines a compartment, and further comprising a power conditioner disposed generally within the compartment, the power conditioner conditioning an input power so as to transform the input power to an output power.

7. A light engine as in claim 6, wherein the power conditioner is spaced from the second housing compartment so as to be thermally insulated from the second housing.

8. A light engine as in claim 7, wherein the second housing compartment is defined in part by a compartment wall, and comprising a plurality of apertures formed through the compartment wall so as to provide ventilation to the compartment.

9. A light engine as in claim 8, wherein the apertures comprise slots.

10. A light engine as in claim 1 additionally comprising a thermally conductive plate formed on the second side of the substrate and a conductive via extends through the substrate to thermally connect the second side plate with at least one of the contact pads in the first region.

11. A light engine as in claim 10 additionally comprising a second housing formed of a thermally conductive material, the second housing engaging the second side plate so that heat from the first region is directed to the second side plate and further to the second housing.

12. A light engine as in claim 11, wherein the light emitting diode module is sandwiched between the first and second housings, a first heat path is defined from the second region to the first housing, and a second heat path is defined from the first region to the second housing.

13. A light engine as in claim 1 additionally comprising a power driver adapted to receive an input power and output a conditioned power, wherein the power driver is attached to the substrate so as to communicate with at least one of the plurality of contact pads of the first region while being thermally insulated from the second region.

14. A light engine as in claim 13 additionally comprising a second housing having an aperture formed therethrough, the second housing attached to the first housing so that the substrate is sandwiched between the first and second housings, the power driver thermally spaced from each of the first and second housings.

15. A light engine as in claim 14 additionally comprising a second plurality of thermally conductive plates formed on the second side of the substrate, each of the second plurality of plates generally corresponding to a respective one of the first plurality of plates, and a plurality of thermally conductive vias extending through the substrate, wherein the plurality of vias are configured to transfer heat between respective ones of the first plurality of plates and the second plurality of plates, wherein the second plurality of plates are configured such that the first region is substantially thermally insulated from the second region, wherein the second housing engages the second plurality of plates.

16. A light engine, comprising:

a light emitting diode (LED) module, comprising:

a thermally nonconductive substrate having a first side and a second side, the first side having a first zone and a second zone, a plurality of LEDs arranged in an LED circuit in the second zone and in thermal communication with a corresponding plurality of thermally conductive plates attached to the first side of the nonconductive substrate in the second zone so that heat generated by the LEDs is communicated from the LEDs to the thermally conductive plates;

an electronic component attached to the LED module in the first zone;

wherein the first zone is thermally insulated from the second zone so that heat generated by the LEDs preferentially flows into the plurality of thermally conductive plates and away from the electronic component in the first zone.

17. A light engine as in claim 16 additionally comprising a heat sink, wherein the LED module is attached to the heat sink so that the plurality of thermally conductive plates in the second zone communicate heat received from the LEDs to the heat sink.

18. A light engine as in claim 16 additionally comprising a power delivery line extending from the electronic component in the first zone to the LED circuit in the second zone so as to apply power to the LED circuit.

19. A light engine as in claim 18, wherein the power delivery line is a conductive circuit trace printed on the substrate.

20. A light engine as in claim 16, wherein an aperture is formed through the substrate in the first zone.

21. A light engine as in claim 20, wherein a power supply wire extends through the aperture and communicates power to the electronic component, and additionally comprising means for communicating power from the electronic component in the first zone to the LED circuit in the second zone so as to apply power to the LED circuit.

22. A light engine as in claim 21, wherein the electronic component is configured to condition power received from the power supply wire and output conditioned power to the means for communicating power.

23. A light engine as in claim 22, wherein the means for communicating power comprises a conductive circuit trace printed on the substrate.

24. A light engine as in claim 16 additionally comprising a first heat sink and a second heat sink, the LED module attached to the first heat sink so that a first heat pathway is established from the first zone to the first heat sink, the LED module attached to the second heat sink so that a second heat pathway is established from the second zone to the second heat sink.

25. A light engine as in claim 24, wherein the first and second heat sinks are spaced from one another.

26. A light engine as in claim 18, wherein the electronic component comprises a power conditioner.

27. A light engine as in claim 18, wherein an aperture is formed through the substrate in the first zone.

28. A light engine as in claim 27, wherein a power supply wire extends through the aperture and communicates power to the electronic component, and wherein the electronic component comprises a power conditioner configured to condition power received from the power supply wire and output conditioned power to the power delivery line.

* * * * *